US007182656B2

(12) United States Patent
Nanami et al.

(10) Patent No.: US 7,182,656 B2
(45) **Date of Patent: *Feb. 27, 2007**

(54) CONTROL SYSTEM FOR SMALL WATERCRAFT

(75) Inventors: Masayoshi Nanami, Shizuoka (JP); Masaki Takegami, Shizuoka (JP); N boru Suganuma, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/717,034

(22) Filed: Nov. 18, 2003

(65) Prior Publication Data

US 2004/0102108 A1 May 27, 2004

Related U.S. Application Data

(63) Continuation of application No. 10/113,869, filed on Mar. 29, 2002, now Pat. No. 6,648,702, which is a continuation of application No. 09/596,786, filed on Jun. 19, 2000, now Pat. No. 6,419,531.

(30) Foreign Application Priority Data

Jun. 17, 1999 (JP) ..... 11-170731

(51) Int. Cl.
*B63H 21/21* (2006.01)
*B63H 21/38* (2006.01)
*B63B 35/73* (2006.01)

(52) U.S. Cl. ..... 440/1; 440/84; 440/88 R

(58) Field of Classification Search ..... 440/1, 440/2, 84, 87, 88 F, 88 L; 123/198 D, 198 DB, 123/198 DC; 340/689, 984–987; 180/282, 180/283; 114/55.5, 55.55, 55.56, 55.57; 200/61.45 R, 61.52

See application file for complete search history.

(56) References Cited

U.S. PATENT DOCUMENTS

| | | | |
|---|---|---|---|
| 2,773,953 | A | 12/1956 | Lawick |
| 3,772,643 | A | 11/1973 | Dodd et al. |
| 3,999,178 | A | 12/1976 | Hamilton |
| 4,011,848 | A | 3/1977 | Coddington |
| 4,050,396 | A | 9/1977 | Ridgeway |
| 4,276,454 | A | 6/1981 | Zathan |
| 4,341,178 | A | 7/1982 | Price |
| 4,766,329 | A | 8/1988 | Santiago |
| 4,871,996 | A | 10/1989 | Tsunamoto et al. |

(Continued)

FOREIGN PATENT DOCUMENTS

| | | |
|---|---|---|
| JP | 08/049596 | 2/1996 |

*Primary Examiner*—Ajay Vasudeva
(74) *Attorney, Agent, or Firm*—Knobbe, Martens, Olson & Bear, LLP

(57) ABSTRACT

A small watercraft with an emergency shut-off system is provided. The emergency shut-off system is configured to shut off the engine of the small watercraft when the small watercraft is overturned. The emergency shut-off system comprises an electronic control unit that is operatively coupled to an overturn sensor and the engine. The electronic control unit is configured to sense a signal generated by the overturn switch. The electronic control unit is also configured to determine if the signal generated by the overturn switch continues for a period longer than a preset amount of time and to shut off the engine if the signal generated by the overturn switch continues beyond the preset amount of time. The electronic control unit can also be configured to activate a bilge pump when a level of water within the watercraft exceeds a predetermined level.

5 Claims, 22 Drawing Sheets

U.S. PATENT DOCUMENTS 5,033,428 A 7/1991 Sasaki
5,846,102 A 12/1998 Nitta et al.
6,024,068 A 2/2000 Nakase et al.
6,419,531 B1 * 7/2002 Nanami et al. ..... 440/1
6,612,881 B2 * 9/2003 Kanno ..... 440/1
6,648,702 B2 * 11/2003 Nanami et al. ..... 440/1
2003/0062209 A1 * 4/2003 Iyoda et al. ..... 180/282
2004/0180585 A1 * 9/2004 Kinoshita ..... 440/1

* cited by examiner

CONTROL SYSTEM FOR SMALL WATERCRAFT

PRIORITY INFORMATION

The present application is a continuation of U.S. patent application Ser. No. 10/113,869, filed Mar. 29, 2002, now U.S. Pat. No. 6,648,702, which is a continuation of U.S. patent application Ser. No. 09/596,786, filed Jun. 19, 2000, now U.S. Pat. No. 6,419,531, the entire contents of both which is hereby expressly incorporated by reference and is based on and claims priority to Japanese Patent Application No. 11-170731, which was filed on Jun. 17, 1999, the entire contents of which is hereby expressly incorporated by reference. The entire contents of Japanese Patent Application No. 11-75968, which was filed on Mar. 19, 1999, is also hereby expressly incorporated by reference.

BACKGROUND OF THE INVENTION

1. Field of the Invention

The present invention generally relates to a control system for a personal watercraft. More particularly, the present invention relates to a emergency shut-off system for a personal watercraft.

2. Description of Related Art

As personal watercraft have become popular, they have become increasingly fast. Today, personal watercrafts are capable of speeds greater than 60 mph. To attain such speeds, personal watercrafts are driven by high power output motors.

Typically, two-cycle engines are used in personal watercraft because two-cycle engines have a fairly high power to weight ratio. One disadvantage of two-cycle engines, however, is that they produce relatively high emissions. In particular, large amounts of carbon monoxide and hydrocarbons are produced during operation of the engine. When steps are taken to reduce these emissions, other undesirable consequences-typically result, such as an increase in the weight of the engine, the cost of manufacture, and/or the reduction of power.

It has been suggested that four-cycle engines replace two-cycle engines in personal watercraft. Four-cycle engines typically produce less hydrocarbon emissions than two-cycle engines while still producing a relatively high power output. However, adapting four-cycle engines for use in personal watercraft has its own engineering and technical challenges.

For example, as compared to two-cycle engines, four-cycle engines are typically more susceptible to water corrosion. Accordingly, personal watercraft with four-cycle engines typically include an emergency shut-off system that prevents water from entering the engine compartment when the personal watercraft is overturned. An example of such an emergency shut-off system is disclosed in Japanese Patent Laid Open No. 8-49596 (1996). This particular emergency shut-off system includes an overturn switch. The overturn switch includes a weight that sways back and forth as the personal watercraft is rocked from side to side. When the weight sways beyond a specified range, a circuit in the overturn switch is closed and the engine is shut off. Thus, the air pressure inside the engine compartment remains positive and water is less likely to be drawn into the engine compartment if the watercraft is overturned.

There, however, are several problems associated the emergency shut-off system described above. In particular, the circuit in the overturn switch can close when the watercraft is making a sharp or quick turn. That is, the weight can sway beyond the specified range during a sharp or quick turn as well as when the watercraft is overturned.

SUMMARY OF THE INVENTION

Thus, there exists a need for a improve emergency shut-off system that does not suffer significantly from these problems.

Thus, one aspect of the present invention is a method of operating an emergency shut-off system for a small watercraft is disclosed. The small watercraft comprises a hull that defines an engine compartment, an internal combustion engine supported within the engine compartment, an overturn switch, and an electronic control unit that is in electrical communication with the overturn switch. A signal from the overturn switch is sensed by the electronic control unit. The emergency shut-off system determines if the overturn switch is generating a signal for at least a preset amount of time. If the overturn switch has generated a signal for at least the preset amount of time, the engine is shut off.

Another aspect of the present invention is another method of operating an emergency shut-off system for a small watercraft. The small watercraft includes a hull that defines an engine compartment, an internal combustion engine supported within the engine compartment, a water level detection sensor positioned in the engine compartment, a bilge pump, and an electronic control unit that is in electrical communication with the sensor and the pump. The electronic control unit senses a signal from the water level detection sensor. The engine is shut off when the water level detection sensor indicates that water in the engine compartment exceeds a preset level. The bilge pump is activated.

Yet another aspect of the present invention is a small watercraft comprising a hull that defines an engine compartment, an internal combustion engine supported within the engine compartment, and an emergency shut-off system. The emergency shut-off system comprises an overturn switch and an electronic control unit that is in electrical communication with the overturn switch and the engine. The electronic control unit is configured to sense a signal generated by the overturn switch. The electronic control unit is also configured to determine if the signal generated by the overturn switch continues for a period longer than a preset amount of time. The electronic control unit is further configure to shut off the engine if the signal generated by the overturn switch continues beyond the preset amount of time.

Another aspect of the present invention is a small watercraft comprising a hull that defines an engine compartment, an internal combustion engine supported within the engine compartment, a water level detection sensor positioned in the engine compartment, a bilge pump positioned within the hull, and an electronic control unit. The electronic control unit is in electrical communication with the bilge pump and the engine. The sensor is configured to send a signal to the electronic control unit when water in the engine compartment rises above a specified level. The electronic control unit is configured to sense the signal from the water level detection sensor, to shut off the engine and to activate a bilge pump that is positioned within the engine compartment.

Another aspect of the present invention is a small watercraft comprising a hull that defines an engine compartment, an internal combustion engine supported within the engine compartment, a bilge pump positioned within the hull, and an electronic control unit in electrical communication with the bilge pump and the internal combustion engine. The watercraft also includes means for shutting off the engine when the watercraft is overturned.

BRIEF DESCRIPTION OF THE DRAWINGS

The above-mentioned and other features of the invention will now be described with reference to the drawings of preferred embodiments of the present invention. The illustrated embodiments of the emergency shut-off system, which are employed in a watercraft, are intended to illustrate, but not to limit, the invention. The drawings contain the following figures.

DETAILED DESCRIPTION OF THE PREFERRED EMBODIMENTS OF THE INVENTION

The present invention generally relates to an improved emergency "disablement" or shut-off system having certain features and advantages in accordance with the present invention. The emergency shut-off system is described in conjunction with a personal watereraft because this is an application in which the system has particular utility. Accordingly, an exemplary personal watercraft 10 will first be described in general detail to assist the reader's understanding of the environment of use. Of course, those of ordinary skill in the relevant arts will readily appreciate that the emergency shut-off system described herein can also have utility in a wide variety of other settings, for example, without limitation, small jet boats and the like.

Figure 18:
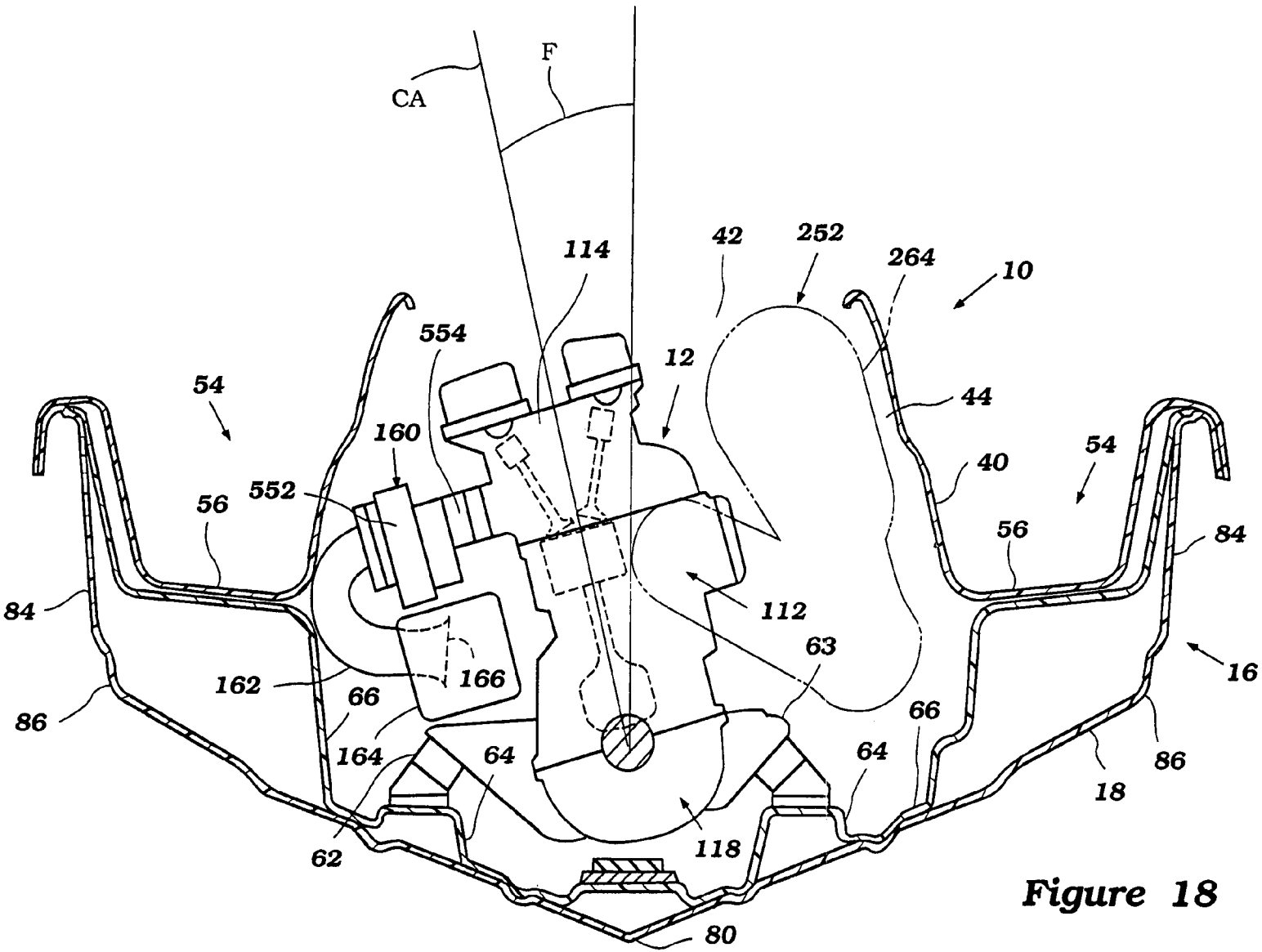
FIG. 18 is a front cross-sectional view of another modified arrangement of the engine.

The small watercraft and a corresponding engine 12 used in the small watercraft will be described with initial reference to FIGS. 1 and 18. With reference to FIG. 18, it is apparent that the engine 12 of FIG. 18 is a modified arrangement of the engine 12 of FIG. 1. Thus, the engine 12 will be described and the modifications to the engine 12 of FIG. 18 will also be described. Like reference numerals will be used for like elements of the personal watercraft 10 and engine 12. The watercraft 10 is also described with reference to a coordinate system. The coordinate system includes a longitudinal axis that extends from the bow to the stem of the watercraft. The coordinate system further includes a lateral axis that extends from the port side to starboard side, in a direction generally normal to the longitudinal axis. Relative heights are expressed as elevations referenced to the undersurface of the watercraft. In addition, several of the figures include a label FR that is used to indicate the general direction in which the watercraft travels during normal forward operation.

Figure 1:
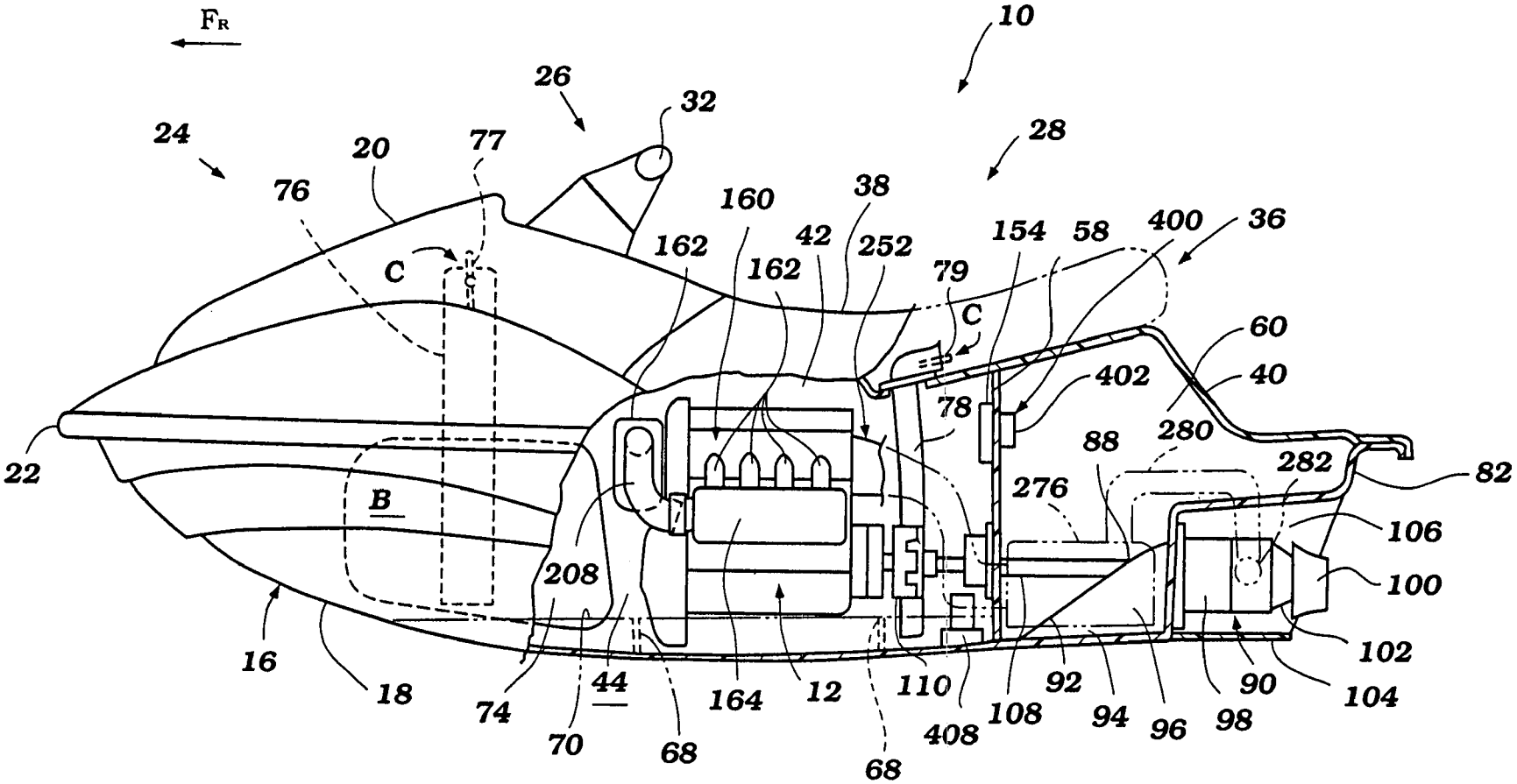
FIG. 1 is a side elevation view of a small watercraft with the rear portion of the watercraft shown in cross-section and certain internal components of the watercraft being illustrated with hidden lines.

With reference now to FIG. 1, the watercraft 10 includes a hull 16 that is defined by a lower portion 18 and a top portion or deck 20. These portions of the hull 16 are preferably formed from a suitable material, such as, for example, a molded fiberglass reinforced resin. A bond flange 22 preferably connects the lower portion 18 to the deck 20. Of course, any other suitable means may be used to interconnect the lower portion 18 and the deck 20. Alternatively, the lower portion 18 and the deck 20 can be integrally formed.

As viewed in the direction from the bow to the stem, the deck 20 includes a bow portion 24, a control mast 26, and a rider's area 28. The bow portion 24 preferably includes a hatch cover (not shown). The hatch cover preferably is pivotally attached to the deck 20 such that it is capable of being selectively locked in a substantially closed watertight position. A storage bin (not shown) preferably is positioned beneath the hatch cover.

The control mast 26 supports a handlebar assembly 32. The handlebar assembly 32 controls the steering of the watercraft 10 in a conventional manner. The handlebar assembly 32 preferably carries a variety of controls for the watercraft 10, such as, for example, a throttle control (not shown), a start switch (not shown), and a lanyard switch (not shown). Additionally, a gauge assembly (not shown) is preferably mounted to the upper deck section 20 forward of the control mast 30. The gauge assembly can include a variety of gauges, such as, for example, a fuel gauge, a speedometer, an oil pressure gauge, a tachometer, and a battery voltage gauge.

The rider area 28 lies rearward of the control mast 26 and includes a seat assembly 36. The illustrated seat assembly 36 includes at least one seat cushion 38 that is supported by a raised pedestal 40. The raised pedestal 40 forms a portion of the upper deck 20, and has an elongated shape that extends longitudinally substantially along the center of the watercraft 10. The seat cushion 38 desirably is removably attached to a top surface of the raised pedestal 40 by one or more latching mechanisms (not shown) and covers the entire upper end of the pedestal 40 for rider and passenger comfort.

An engine access opening 42 is located in the upper surface of the illustrated pedestal 40. The access opening 42 opens into an engine compartment 44 formed within the hull 16. The seat cushion 38 normally covers and substantially seals the access opening 42 to reduce the likelihood that water will enter the engine compartment 44. When the seat cushion 38 is removed, the engine compartment 44 is accessible through the access opening 42.

With particular reference to FIG. 18, the upper deck portion 20 of the hull 16 advantageously includes a pair of generally planar areas 54 positioned on opposite sides of the seat pedestal 40, which define foot areas 56. The foot areas 56 extend generally along and parallel to the sides of the pedestal 40 and are substantially enclosed on the lateral sides by the pedestal 40 and a raised gunnel. In this position, the operator and any passengers sitting on the seat assembly 36 can place their feet on the foot areas 56 during normal operation of the watercraft 10 and the feet generally are protected from water passing along the sides of the moving watercraft. A nonslip (e.g., rubber) mat desirably covers the foot areas 56 to provide increased grip and traction for the operator and passengers.

The interior of the hull 16 includes one or more bulkheads 58 (see FIG. 1) that can be used to reinforce the hull 16 internally and that also can serve to define, in part, the engine compartment 44 and a propulsion compartment 60 (see FIG. 1), which propulsion compartment 60 is arranged generally rearward from the engine compartment 44. The engine 12 is mounted within the engine compartment 44 in any suitable manner preferably at a central transverse position of the watercraft 10. Preferably, a set of resilient engine mounts 62 are used to connect the engine 12 to a set of stringers 64. The illustrated stringers 64 are formed on a liner 66, which can also include other contours and mounting surfaces. The liner 66 can be made out of any suitable material, such as molded fiberglass reinforced resin. The liner 66 preferably is bonded to the inner surface of the lower hull portion 18. In another arrangement, the stringers 64 may be molded into the lower portion 18 of the hull 16, or may be formed separately and then bonded to the inner surface of the lower portion 18. In yet another arrangement, which is illustrated in FIG. 1, the hull 16 includes one or more dividing boards 68 that extend in a transverse direction along the inner surface of the lower hull portion. The transversely extending dividing boards 68 support a longitudinally extending dividing board 70 that can be used to support the engine mounts 62.

With reference again to FIG. 1, a fuel tank 74 preferably is arranged in front of the engine 12 and is suitably secured to the hull 16 of the watercraft 10. A fuel filler tube (not shown) preferably extends between the fuel tank 74 and the upper deck 20, thus allowing the fuel tank 74 to be filled with fuel B via the tube.

A forward air duct 76 extends through the upper deck portion 20. The forward air duct 76 allows atmospheric air C to enter and exit the engine compartment 44. Similarly, a rear air duct 78 extends through an upper surface of the seat pedestal 40, preferably beneath the seat cushion 38, thus also allowing atmospheric air C to enter and exit the engine compartment 44. Preferably, the rear air duct 78 terminates below the longitudinally extending dividing board 70. Air may pass through the air ducts 76, 78 in both directions (i.e., into and out of the engine compartment 44). Except for the air ducts 76, 78, the engine compartment 44 is substantially sealed so as to enclose the engine 12 of the watercraft 10 from the body of water in which the watercraft 10 is operated.

Both the forward and rear air ducts 76, 78 preferably include shut-off valves 77, 79. The shut-off valves 77, 79 can be made in a variety of ways but in the illustrated embodiment they are butterfly valves. Preferably, the shut-off valves 77, 79 are positioned in the forward and rear air ducts, 76, 78 such that they lie above the engine compartment 44. The shut-off valves 77, 79 are connected to actuators, which open and close the shut-off valves 77, 79. The purpose and function of the shut-off valves 77, 79 will be described in detail below.

The lower hull section 18 is designed such that the watercraft 10 planes or rides on a minimum surface area of the aft end of the lower hull section 18 in order to optimize the speed and handling of the watercraft 10 by reducing the wetted surface area, and therefore the drag associated with that surface area. For this purpose, as best seen in FIG. 18, the lower hull section 18 has a generally V-shaped configuration formed by a pair of inclined sections that extend outwardly from a keel line 80 to outer chines 86 at a dead rise angle. The inclined sections extend longitudinally from the bow 24 toward the transom 82 (see FIG. 1) of the lower hull section 18 and extend outwardly to sidewalls 84 of the lower hull section 18. The sidewalls 84 are generally flat and straight near the stern of the lower hull section 18 and smoothly blend towards a longitudinal center of the watercraft 10 at the bow. The lines of intersection between the inclined sections and the corresponding sidewalls 84 form the outer chines 86 which affect handling, as known in the art.

With reference again to FIG. 1, toward the transom 82 of the watercraft 10, the inclined sections of the lower hull section 18 extend outwardly from a recessed channel or tunnel 88 that is recessed within the lower hull section in a direction that extends upward toward the upper deck section 20. The tunnel 88 has a generally parallelepiped shape and opens through the transom 82 of the watercraft 10.

In the illustrated watercraft, a jet pump unit 90 propels the watercraft 10. The jet pump unit 90 is mounted within the tunnel 88 formed on the underside of the lower hull section 18 by a plurality of bolts (not shown). An intake duct 92, defined by the hull tunnel 88, extends between the jet pump unit 90 and an inlet opening 94 that opens into a gullet 96. The duct 92 leads to an impeller housing 98.

A steering nozzle 100 is supported at the downstream end of a discharge nozzle 102 of the impeller housing 98 by a pair of vertically extending pivot pins (not shown). In an exemplary embodiment, the steering nozzle 100 has an integral lever on one side that is coupled to the handlebar assembly 32 through, for example, a bowden-wire actuator, as known in the art. In this manner, the operator of the watercraft 10 can move the steering nozzle 100 to effect directional changes of the watercraft 100.

A ride plate 104 covers a portion of the tunnel 88 behind the inlet opening 94 to enclose the jet pump unit 90 within the tunnel 88. In this manner, the lower opening of the tunnel 88 is closed to provide a planing surface for the watercraft 10. A pump chamber 106 thus is at least partially defined within the tunnel section 88 covered by the ride plate 104.

An impeller shaft 108 supports an impeller (not shown) within the impeller housing 98. The aft end of the impeller shaft 108 is suitably supported and journaled within a compression chamber of the housing 98 in a known manner. The impeller shaft 108 extends in a forward direction through the bulkhead 58. A protective casing preferably surrounds a portion of the impeller shaft 108 that lies forward of the intake gullet 96. The forward end of the impeller shaft is connected to the engine 12 via a toothed coupling 110.

The engine 12, which drives the jet pump unit 90, will now be described with initial reference to FIGS. 1 and 2. The illustrated engine 12 is a four-stroke, in-line straight four cylinder engine. However, it should be appreciated that several features and advantages of the present invention can be achieved utilizing an engine with a different cylinder configuration (e.g., v-type, w-type or opposed), a different number of cylinders (e.g., six) and/or a different principle of operation (e.g., two-cycle, rotary, or diesel principles).

The engine 12 comprises an engine body 112 having a cylinder head 114, a cylinder block 116 and a crankcase 118. The crankcase 118 defines a crankcase chamber 119. The cylinder block 116 preferably is formed with four generally vertically extending cylinder bores 120. The cylinder bores 120 may be formed from thin liners that are either cast or otherwise secured in place within the cylinder block 116. Alternatively, the cylinder bores 120 may be formed directly in the base material of the cylinder block 116. If a light alloy casting is employed for the cylinder block 116, such liners can be used.

As mentioned above, the illustrated engine 12 is a four cylinder engine; thus, the cylinder block 116 includes four cylinder bores 120. A piston 122 is provided within each cylinder bore 120 and is supported for reciprocal movement therein. Piston pins 124 connect the pistons 122 to respective connecting rods 126. The connecting rods 126, are journaled on the throws of a crankshaft 128. The crankshaft 128 is journaled by a plurality of bearings within the crankcase 118 to rotate about a crankshaft axis that lies generally parallel to the longitudinal axis of the watercraft 10. As will be explained in more detail below, the crankcase 118 preferably comprises an upper crankcase member 130 and a lower crankcase member 132, which are attached to each in any suitable manner.

The cylinder head 114 is provided with individual recesses which cooperate with the respective cylinder bores 120 and the heads of the pistons 122 to form combustion chambers 134. These recesses are surrounded by a lower cylinder head surface that is generally planar and that is held in sealing engagement with the cylinder block 116, or with cylinder head gaskets (not shown) interposed therebetween, in a known manner. This planar surface of the cylinder head 114 may partially override the cylinder bores 120 to provide a squish area, if desired. The cylinder head 114 may be affixed to the cylinder block 116 in any suitable manner.

Poppet-type intake valves 136 are slidably supported in the cylinder head 114 in a known manner, and have their head portions engageable with valve seats so as to control the flow of the intake charge into the combustion chambers 134 through intake passages 138 formed in the cylinder head 114. The intake valves 136 are biased toward their closed position by coil compression springs 140. The valves 136 are operated by an intake camshaft 142 which is suitably journaled in the cylinder head 114 in a known manner. The intake camshaft 142 has lobes that operate the intake valves 136 through thimble tappets.

Figure 3:
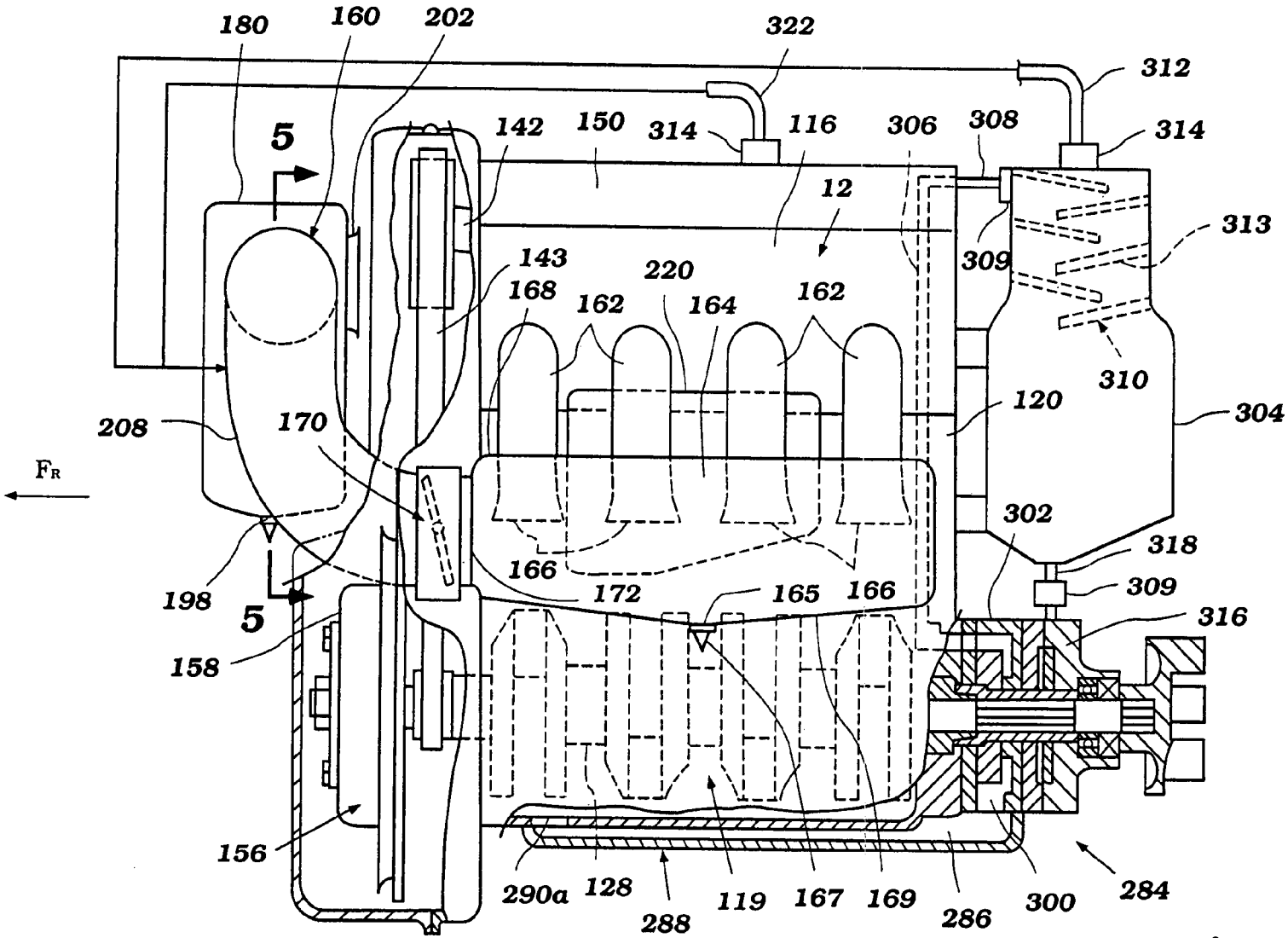
FIG. 3 is an enlarged left side view of the engine with a lower portion of the engine shown in cross-section and certain internal components being illustrated with hidden lines.

The intake camshaft 142 is driven by the crankshaft 128 via a camshaft drive mechanism, which is partially shown in FIG. 3. In particular, the camshaft drive mechanism includes a timing belt 143 that couples the crankshaft 128 to the intake camshaft 142. The camshaft drive mechanism is well known in the art; thus, a further description of this mechanism is not necessary for one of ordinary skill in the art to practice the present invention.

Figure 2:
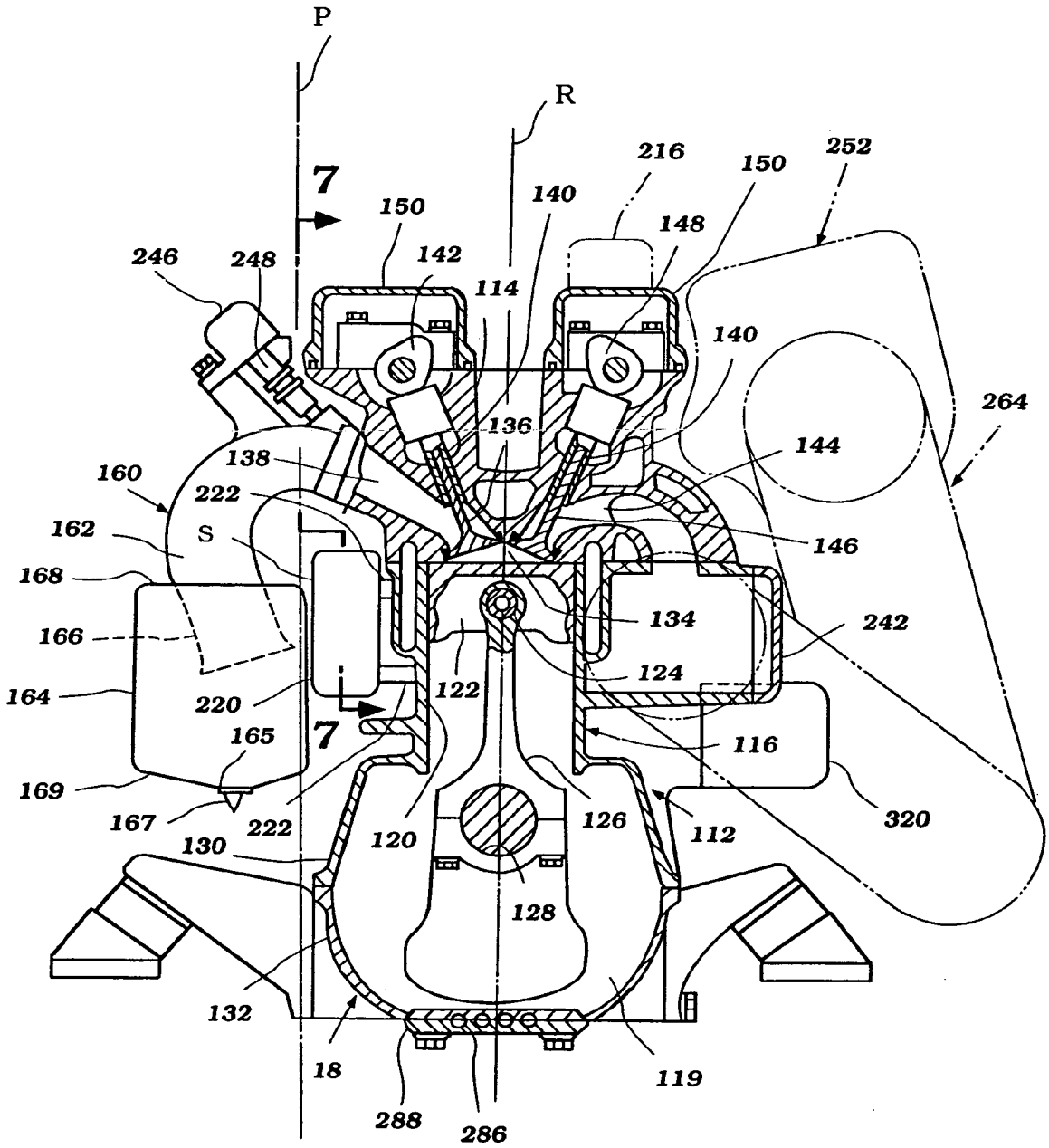
FIG. 2 is a front cross-sectional view of an engine of the watercraft.

With particular reference to FIG. 2, the cylinder head 114 includes at least one exhaust passage 144 for each combustion chamber 134. The exhaust passages 144 emanate from one or more valve seats formed in the cylinder head 114. At least one exhaust valve 146 is supported for reciprocation in the cylinder head 114 for each combustion chamber 134, in a manner similar to the intake valves 136. The exhaust valves 146 also are biased toward their closed position by coiled compression springs 140. An overhead mounted exhaust camshaft 148 opens and closes the exhaust valves 146. As with the intake camshaft 142, the exhaust camshaft 148 is suitably journaled for rotation in the cylinder head 114 and includes cam lobes that cooperate with thimble tappets for operating the exhaust valves 170 in a known manner. In the illustrated engine, the rotational axis of the intake camshaft 142 and the exhaust camshaft 148 are parallel to each other. Like the intake camshaft 142, the crankshaft 128 drives the exhaust camshaft 148 in a known manner.

A valve cover 150 encloses the camshafts 142, 148 and is sealably engaged with an upper surface of the cylinder head 114. As such, the valve cover 150 protects the camshafts 142, 148 from foreign material and entraps any lubricants provided to the camshafts 142, 148.

A suitable ignition system is provided for igniting an air and fuel mixture that is provided to each combustion chamber 134. Spark plugs 152 (FIG. 4) preferably are fired by a suitable ignition system, which can include an electronic control unit (ECU) 154 connected to the engine 12 by one or more electrical cables. Preferably, the ECU 154 is mounted to the bulkhead 58 in a recess 173. A pulsar-coil (not shown), which may be incorporated into the ECU 154, generates firing signals for the ignition system. In addition, the ignition system may include a battery for use in providing power to an electric starter and the like. The crankshaft 128 is preferably coupled to a flywheel assembly 156 (FIG. 3), which preferably is located in front of the engine 12. The flywheel assembly 156 includes a flywheel magneto (not shown) that forms part of the ignition system. A cover 158 is attached to the front end of the cylinder block 116 and cylinder head 114 to enclose the flywheel assembly 156.

FIGS. 1–5 illustrate an engine air intake system 160 having certain features, aspects and advantages in accordance with the present invention. With initial reference to FIGS. 2 and 3, the illustrated engine air intake system 160 includes intake pipes 162 that communicate with the intake passages 138 formed in the cylinder head 114. The intake pipes 162 extend generally downwardly from the cylinder head 114 and communicate with an intake chamber 164, which preferably is positioned entirely lower than the cylinder head 114. The intake chamber 164 is positioned generally below the intake pipes 162 and along a side of the engine 12. Inlets 166 (illustrated in dashed lines) of the intake pipes 162 preferably lie below a top wall 168 of the intake chamber 164. A bottom wall 169 of the intake chamber 164 is preferably inclined so as to converge to a bottom wall low point 165. A one-way valve 167 is preferably located at the low point 165. In this manner, fluid within the intake chamber 164 is collected at the low point 165 and drained from the chamber 164 through the valve 167. In the illustrated embodiment, the low point 165 is positioned generally centrally in the intake chamber 164. Alternatively, the bottom wall 169 can be arranged so that the low point 165 is disposed at any location along the bottom wall 169. For example, the low point could be positioned at either end of the bottom wall or adjacent a corner of the chamber 164.

Figure 4:
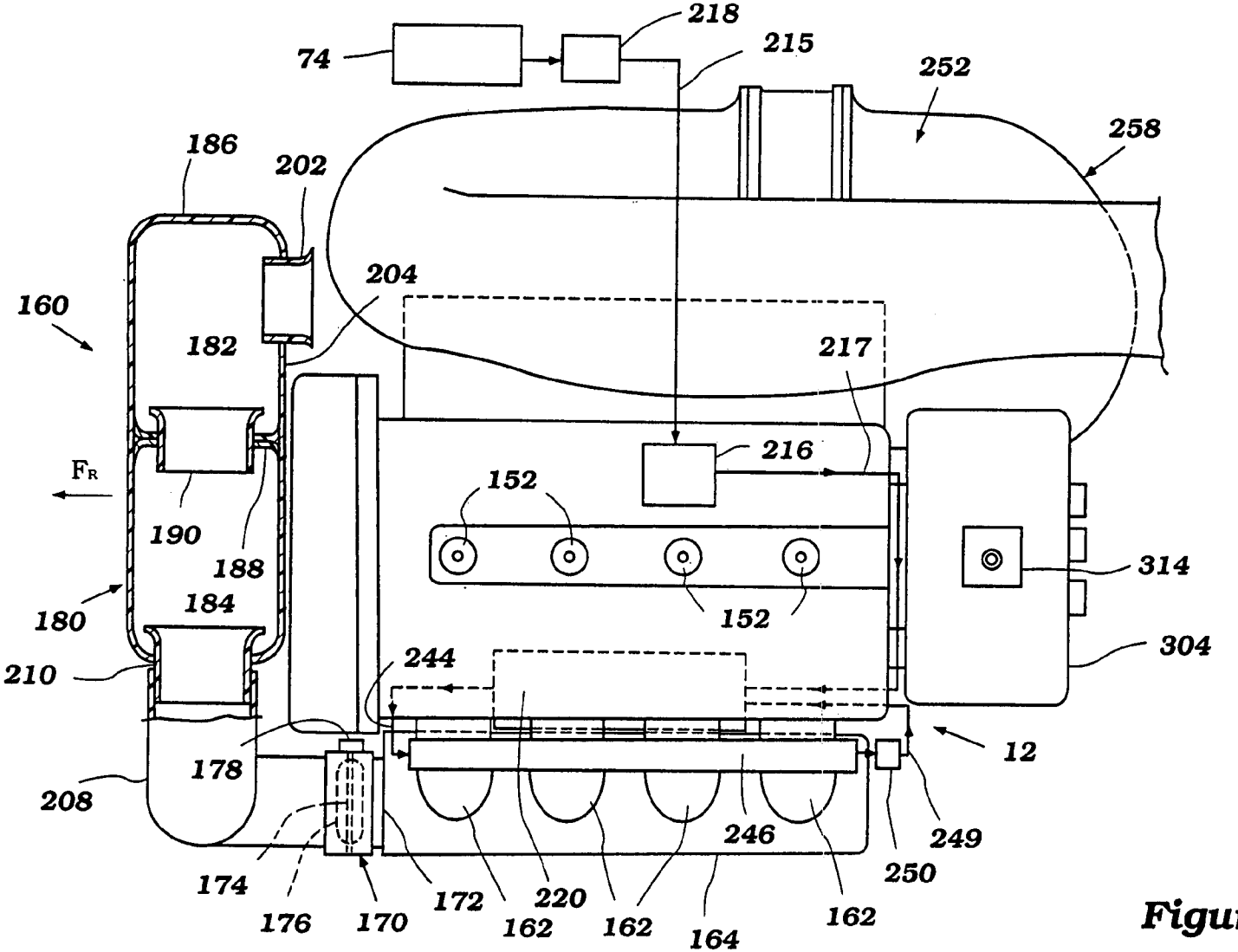
FIG. 4 is a top plan view of the engine with a cross-sectional view of an intake silencer taken along line 4—4 of FIG. 5.

With reference now to FIGS. 3 and 4, a butterfly-type throttle valve 170 preferably is located upstream of an inlet 172 to the intake chamber 164. As is typical with butterfly-type valves, the illustrated throttle valve 170 includes a valve shaft 174 and a valve disc 176. The throttle valve 170 regulates the amount of air C delivered to the engine 12 in a manner well known to those of ordinary skill in the art. Preferably, the throttle valve 170 is controlled by a throttle valve control system, which includes the ECU 154, a throttle valve actuator (not shown), and a throttle valve position sensor 178. The ECU 154 senses the position of the throttle valve 170 through the valve position sensor 178 and controls the opening and closing of the valve 170 through the throttle valve actuator. In an alternative embodiment, a throttle valve 170 could be positioned in each of the intake pipes 162.

Figure 5:
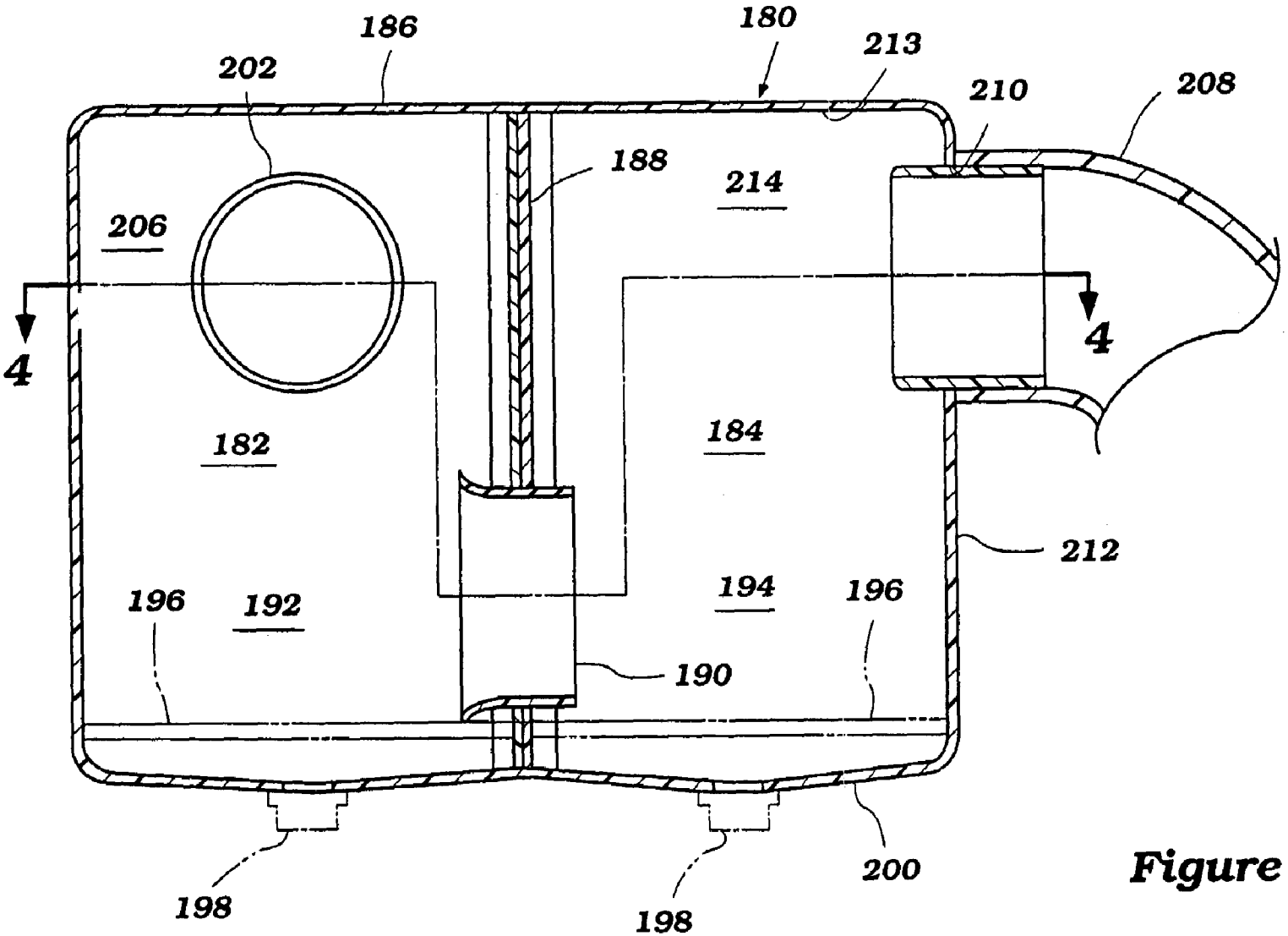
FIG. 5 is a cross-sectional view of the intake silencer taken along line 5—5 of FIG. 3.

With particular reference to FIGS. 3–5, an intake silencer 180 is positioned generally in front of the illustrated engine 12. The intake silencer 180 preferably is divided into an upstream chamber 182 and a downstream chamber 184. A casing 186 defines an internal volume of the intake silencer 180, and a dividing wall 188 divides the internal volume into the upstream and downstream chambers 182, 184. The upstream and downstream chambers 182, 184 communicate with each other through a connection pipe 190 that extends through the dividing wall 188. As best seen in FIG. 5, the connection pipe 190 preferably connects a lower section 192 of the upstream chamber 182 to a lower section 194 of the downstream chamber 184.

A lower wall 200 of each chamber 182, 184 is preferably inclined so as to converge to a chamber low point 195. A one-way valve 198 is preferably located at each low point 195. A one-way valve 198 is preferably positioned on the lower wall 200 of each chamber 182, 184 at the low point 195. In this manner, fluid within the chambers is collected at the low points 195 and drained through the valve 198. As with the low point 165 of the intake chamber 164, the low points 195 of the upstream and downstream chambers 182, 184 can be positioned at any location along the lower wall 200.

Each chamber 182, 184 of the intake silencer 180 preferably includes a dividing plate 196 located near the bottom of the chamber and adjacent the lower wall 200. The dividing plate 196 includes multiple holes. The purpose and function of the one-way valves 198 and the dividing plate 196 will be described below.

With continued reference to FIGS. 3–5, the intake silencer 180 includes at least one inlet 202, which is open to the engine compartment 44. The inlet 202 allows air C from the engine compartment 44 to flow into the upstream chamber 182 of the air intake silencer 180. The inlet 202 preferably is located on a side wall 204 (FIG. 4) of the intake silencer 180 such that the inlet 202 opens towards the engine 12. This arrangement reduces the likelihood that water may splash into the inlet 202. As best seen in FIG. 5, the inlet 202 opens to an upper section 206 of the upstream chamber 182.

An intake duct 208 connects the downstream chamber 184 of the intake silencer 180 to the intake chamber 164. Preferably, the intake duct 208 extends downwardly and rearwardly from the intake silencer 180 to the intake chamber 164. As best seen in FIG. 5, the intake duct 208 connects to an outlet 210 of the intake silencer 180. The outlet 210 preferably is located on a vertical end wall 212 of the intake silencer 180. More preferably, the outlet 210 is positioned on the vertical side wall such that it is distanced from the top wall 213 of the intake silencer 180. Moreover, the outlet 210 preferably communicates with an upper section 214 of the upstream chamber 182, which lies generally vertically above the connection pipe 190.

One of the features and advantages of the intake system 160 described above is that it prevents water from entering the engine 12. For example, when the watercraft 10 is rocked vigorously, water can get into the engine compartment 44 through the forward and rear air ducts 76, 78, or other openings in the hull 16. Once inside, the water can be drawn into the upstream chamber 182 of the intake silencer 180. Air C flows through the intake silencer 180 along a flow path from the inlet 202 through the connection pipe 190 and out the outlet 210. Since the inlet 202 and outlet 210 are preferably positioned in the upper sections 206, 214 of their respective chambers 182, 184 and the connection pipe connects the lower sections 192, 194 of the chambers 182, 184, the flowing air C must drastically change directions as it flows through the intake silencer 180. Thus, water in the air will be deposited onto the inner walls of the intake silencer 180 and separated from the air. The water collects at the bottom of the intake silencer 180 and is discharged to the through the one-way valves 198. The dividing plate 196 reduces waves in the accumulated water that may form due to vigorous rocking of the watercraft 10. This also reduces the amount of water mist that is formed from splashing waves.

If the watercraft 10 overturns, the accumulated water in the intake silencer 180 does not enter the intake duct 208 because the outlet 210 of the intake silencer 180 is located on the end wall 212 and is spaced from the top wall 213. Accordingly, the outlet 210 is positioned above the inner bottom surface of the intake silencer 180 when the watercraft 10 is overturned. Thus, at the time of the overturn, the accumulated water is less likely to flow through the outlet 210 into the intake duct 208.

The intake chamber 164 and intake pipes 162 also are arranged to prevent water from entering the engine 12. Specifically, and as mentioned above, the intake pipes 162 extend downwardly from the cylinder head 114. The intake chamber 164 is connected to the lower ends of the intake pipes 162. Air C entering the intake chamber 164 through the throttle valve 170 must change from a rearward flow direction to an upward flow direction to enter the intake pipes. Thus, water entrained in air that flows into the intake chamber 164 tends to deposit along the inner walls and settle at the bottom of the intake chamber 164. Water that may flow from the intake duct 208 into the intake chamber 164 also will collect at the bottom of the intake chamber 164. The accumulated water is discharge through the one-way valve 167 located at the bottom of the intake chamber 164.

Additionally, the inlets 166 of the intake pipes 162 preferably lie below and are spaced from the top wall 168 of the intake chamber 164. If the watercraft 10 is overturned so that the top wall 168 becomes the bottom surface of the intake chamber 164, water within the intake chamber 164 will not flow into the intake pipes 162.

Accordingly, the intake system 160 protects the engine 12 from water that may enter the engine compartment 44.

Moreover, the components of the intake system 160 are generally near the bottom of the watercraft 10. This lowers the center of gravity and increases the turning ability of the watercraft 10.

The watercraft 10 also includes a fuel supply system that delivers fuel to the engine 12. The main components of the fuel supply system generally are illustrated in FIGS. 1, 2, 4, and 7. The fuel supply system includes the fuel tank 74, which is shown schematically in FIG. 4. A low pressure pump 216 draws fuel from the fuel tank 74 through a fuel line 215 and through a fuel filter 218. The fuel filter 218 separates water and other contaminants from the fuel. The low pressure pump 216, which is preferably positioned on the valve cover 150, supplies fuel to a vapor separator assembly 220 through a low pressure fuel line 217.

Figure 7:
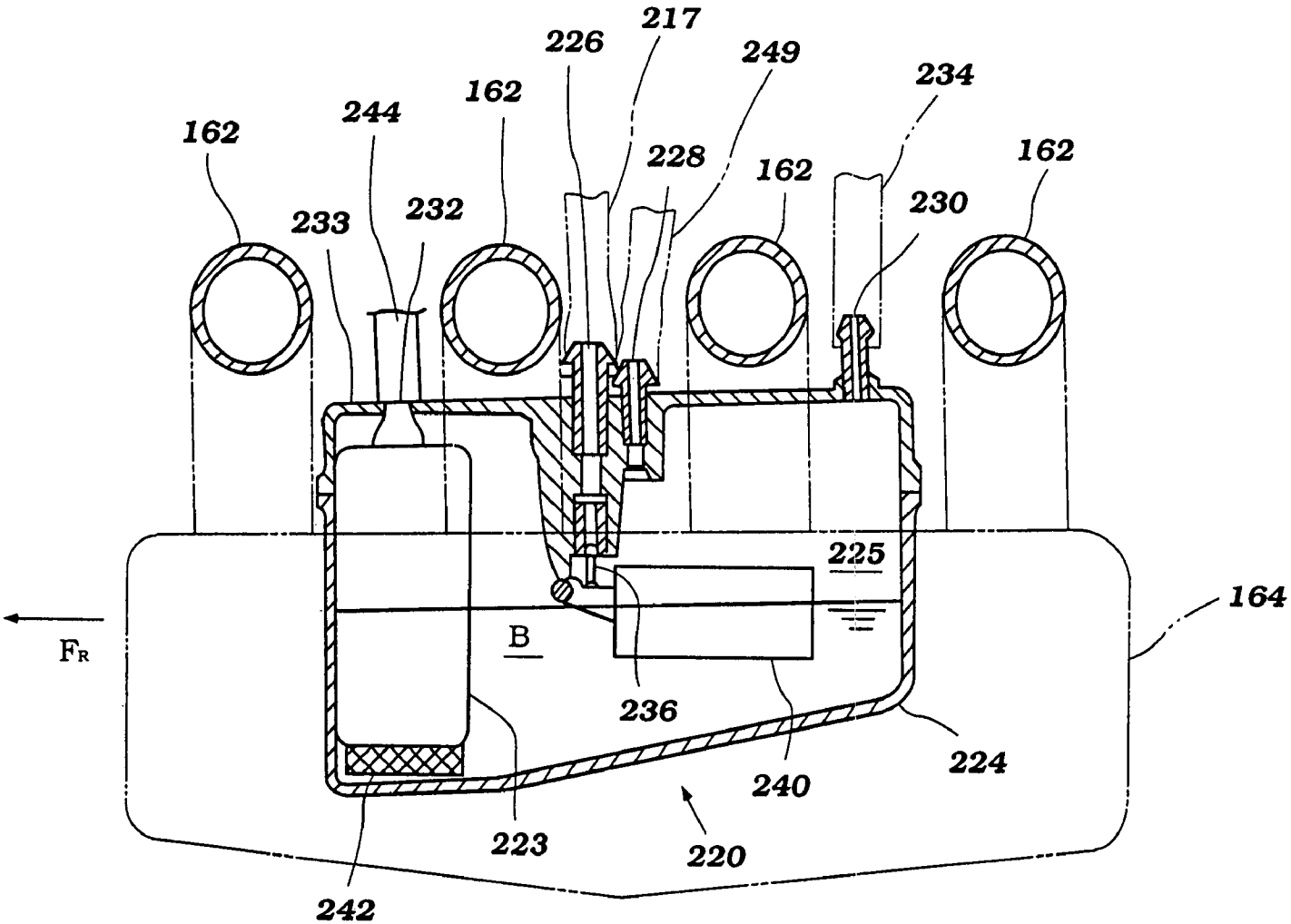
FIG. 7 is a cross-sectional view of a set of intake pipes and a vapor separator taken along line 7—7 of FIG. 2.
Figure 8A:
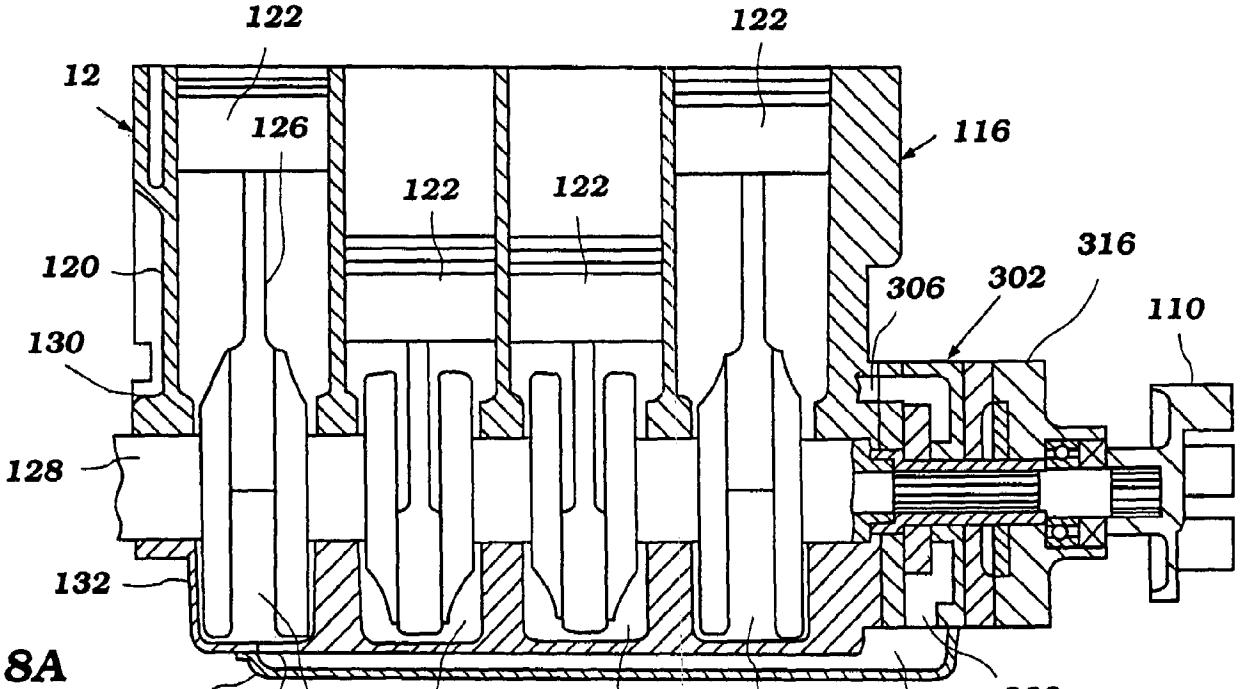
FIG. 8A is a cross-sectional view of the lower portion of the engine.
Figure 8B:
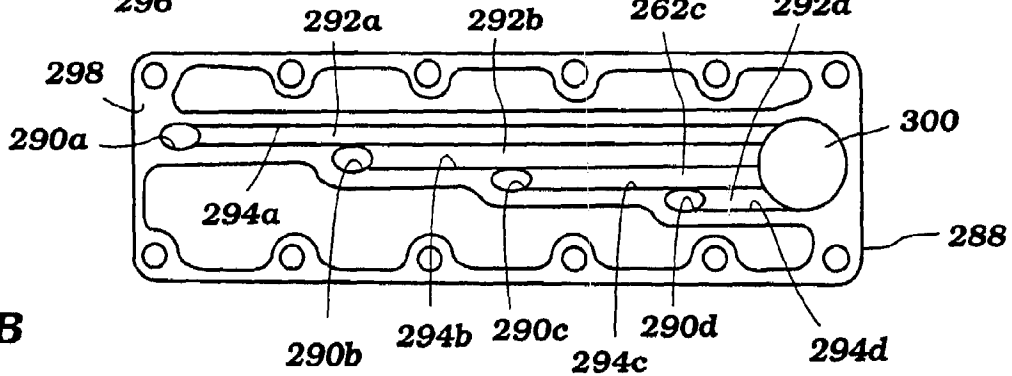
FIG. 8B is a top plan view of a lower cover.

As best seen in FIGS. 2 and 7, the vapor separator 220 preferably is positioned under the intake pipes 162 of the intake system 160. More preferably, the vapor separator 220 is located in the dead space S (i.e., open space not occupied by other components) between the intake chamber 164, the intake pipes 162, and the engine 12. With reference to FIG. 2, a generally vertical datum or reference plane R is defined along the axis of the crankshaft 128. In addition, a plane P that is generally parallel to the reference plane R is defined at an outermost surface of the crankcase 118, the cylinder head 114 (i.e., the valve cover 150) or both (as illustrated), and the vapor separator 220 preferably is positioned between these two planes P,R.

With reference to FIG. 4, the vapor separator can be formed in two portions that are integrally formed with the cylinder block and the cylinder head. One portion can include one or more support ribs 222. In this arrangement, the vapor separator 220 is mounted to a side of the engine 12 by one or more of the support ribs 222.

With reference again to FIG. 2, the intake pipes 162 extend upward from the intake box 164 and inward toward the engine 12. A protective pocket S is defined below the intake pipes 162, inward of the intake box 164 and outward of the engine 12. In some arrangements, portions of the engine 12 (e.g., the cylinder head and the cylinder body) can project outward toward the intake box to further protect the vapor separator. Of course, portions of the intake box can be extended inward in combination with, or in lieu of, protuberances formed on the engine. In the illustrated arrangement, a portion of the cylinder head 114 overhangs beyond the cylinder body 116 and a portion of the cylinder body 116 extends outward to form a protuberance.

It is anticipated that a recess can be formed between the air intake box 164 and the cylinder block 116 to house the vapor separator 220 (e.g., the recess can be formed in one member or both members). Thus, the vapor separator 220 can be at least partially integrated (i.e., manufactured in a single piece) into the cylinder block and cylinder head in some arrangements. In such arrangements, however, it is preferred that the vapor separator be spaced from the cylinder body to reduce the amount of heat transferred between the cylinder bore and the vapor separator. This arrangement protects the vapor separator 220 and the lines (e.g., the low pressure fuel line 217) connected to the vapor separator 220 from splashing water that has entered the engine compartment. This is desired because the vapor separator 220 and lines connected to the vapor separator 220 are preferably made of aluminum, which can be damaged by water.

With particular reference to FIG. 7, the vapor separator 220 includes a high-pressure pump 223, which is positioned within a housing 224 of the vapor separator 220. The housing 224 defines a fuel bowl 225 of the vapor separator 220. A sloped bottom surface of the housing 224 funnels the fuel towards an inlet of the high pressure pump 223.

The vapor separator 220 also includes an inlet port 226, a return inlet port 228, a vapor discharge port 230, and an outlet port 232. Preferably, these ports are located on an upper wall 233 of the vapor separator 220. More preferably, these ports are positioned to extend between adjacent intake pipes. In this manner, the vapor separator 220 can be more compactly arranged with the intake pipes 162. Such a construction further protects the vapor separator 220 from substantial water damage.

The outlet port 232 communicates with an outlet of the high pressure pump 223. The vapor discharge port 230 is positioned to the side of the inlet port 226 at a position proximate to the upper end of the housing 224. The vapor discharge port 230 communicates with a conduit 234 that communicates with the intake system 160 thus recirculating the vapors back into the intake air in any suitable manner.

The inlet port 226 connects to the lower pressure fuel line 217 that extends from the low pressure pump 216. A needle valve 236 operates at a lower end of the intake port 226 to regulate the amount of fuel within the fuel bowl 225. Specifically, a float 240 that is located within the fuel bowl 225 actuates the needle valve 236 in a known manner. When the fuel bowl 225 contains a low level of fuel B, the float 240 lies in a lower position and opens the needle valve 236. When the fuel bowl 225 contains a pre-selected amount of fuel B, the float 240 is disposed at a level where it causes the needle valve 236 to close.

The high pressure pump 223 draws fuel through a fuel strainer 242. The fuel strainer 242 lies generally at the bottom of the fuel bowl 225. Preferably, the high pressure pump 223 is an electric pump. The high pressure pump 223 draws fuel B from the fuel bowl 225 and pushes the fuel B through the outlet port 232 and into a high pressure fuel line 244, which is connected to a fuel rail or manifold 246 (FIGS. 2 and 4).

With reference again to FIG. 2, the fuel rail 246 delivers fuel to a plurality of fuel injectors 248. Preferably, the fuel injectors 248 are situated such that there is at least one fuel injector 248 associated with each intake pipe 162 and intake passage 138. That is, in the illustrated embodiment, the fuel injectors 248 inject fuel B directly into the air stream passing through the intake pipes 162 and the corresponding intake passages 138. Preferably, the fuel injectors 248 are opened and closed by solenoid valves, which are, in turn, controlled by the ECU 154. As will be recognized by those of ordinary skill in the art, certain features, aspects and advantages of the present invention can be used with directly injected engines and carburetted engines as well.

As shown in FIG. 4, a fuel return line 249 extends between an outlet port of the fuel rail 246 and the return port 228 of the vapor separator 220. Preferably, a pressure regulator 250 is positioned in the return line 249. The pressure regulator 250 maintains the desired fuel pressure at the injectors 248 by bypassing (or returning) some of the fuel to the vapor separator.

The watercraft 10 also includes an engine exhaust system 122 that is illustrated in FIGS. 1, 2, 4, and 6. The exhaust system 122 guides exhaust gases produced by the engine 12 to the atmosphere. The engine exhaust system 252 includes the exhaust passages 144, which communicate with each of the combustion chambers 134 and that are formed within the engine 12, and an exhaust manifold 254 that communicates with each of the exhaust passages 144. In the illustrated arrangement, the exhaust manifold 254 is formed integrally with the engine block 116 (see FIG. 2).

Figure 6:
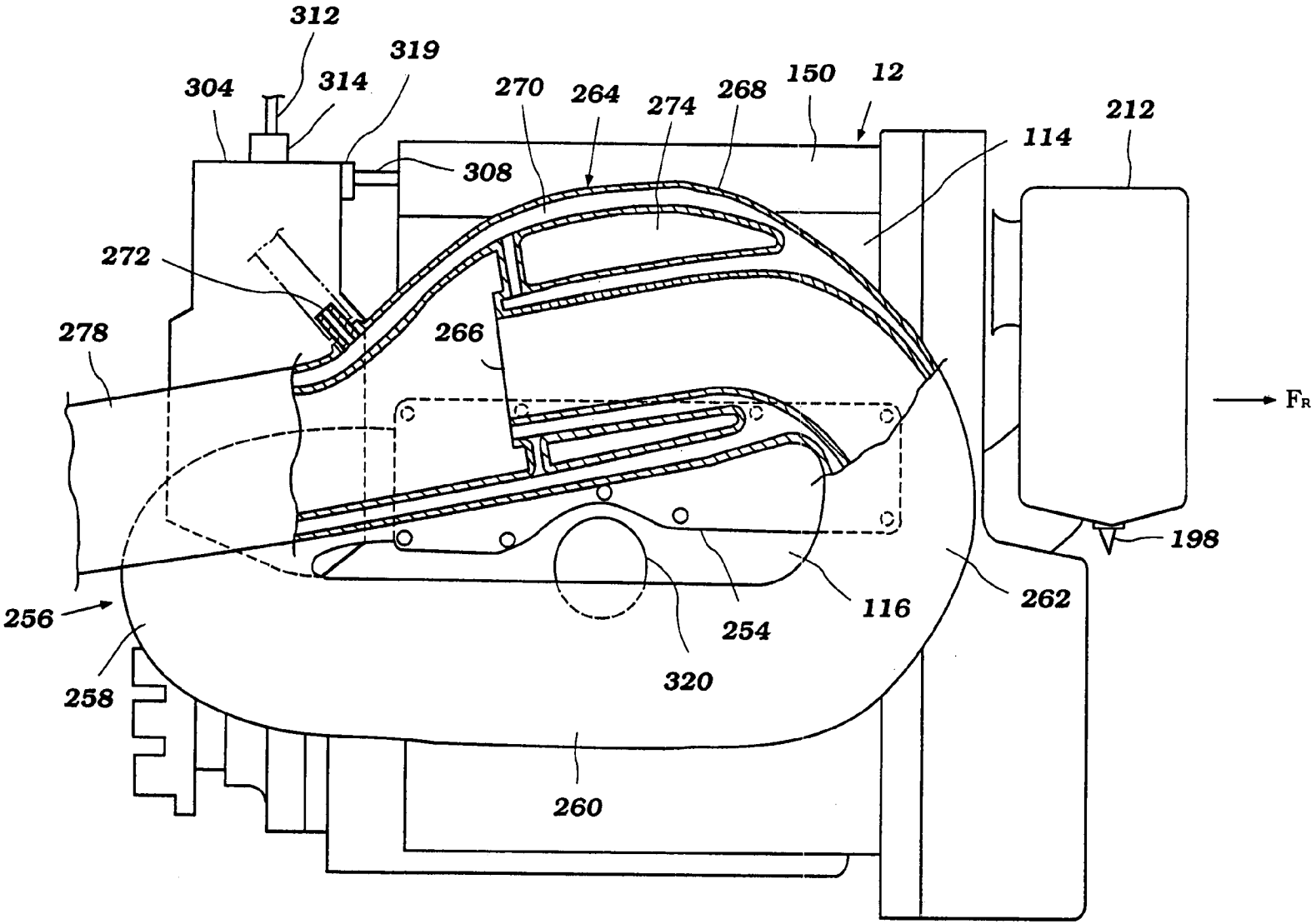
FIG. 6 is an enlarged right side view of the engine with a portion of an exhaust system shown in cross-section.

As best seen in FIG. 6, an exhaust pipe 256 is connected to the exhaust manifold 254. The exhaust pipe 256 includes an upstream portion 258 that extends rearwardly, downwardly, and then forwardly from the exhaust manifold 254. The upstream portion 258 is connected to a generally horizontal portion 260 that extends forwardly from the upstream bent portion 258. A downstream bent portion 262 extends upwardly from the horizontal portion 260 and is connected to an exhaust collection chamber 264.

The chamber 264 includes as protruding section 266 that opens up into an enlarged chamber 268, which is configured to attenuate the noise carried by the flow of exhaust gases, in a known manner. The expansion chamber 264 and the exhaust pipe 256 preferably include cooling passages 270 that are connected to a cooling system by a coolant pipe 272. The cooling system cools the exhaust gases, the exhaust pipe 256, and the expansion chamber 264 in a known manner.

The expansion chamber 264 communicates with a water lock 276 via a second exhaust pipe 278, as shown in FIG. 1. The water lock 276 is a well-known device that allows exhaust gases to pass, but contains a number of baffles (not shown) that prevent water from passing back through the second exhaust pipe 278 and the expansion chamber 264 and into the engine 12. In the illustrated arrangement, the water lock 278 is located on one side of the hull tunnel 88.

The water lock 278 transfers exhaust gases to a third exhaust pipe 280. The third exhaust pipe 280 extends upwardly, rearwardly and then downwardly to a discharge 282 formed on the hull tunnel 88. The third exhaust pipe 282 discharges the exhaust gases to the pump chamber 106, such that the passage of water through the exhaust pipe 282 into the water lock 278 is further inhibited.

The watercraft 10 also includes a dry sump-type lubrication system for lubricating various components of the engine 12. The lubrication system is referred to generally by the reference numeral 180 and is illustrated in FIGS. 2, 3, 8A, and 8B.

The lubrication system 180 includes lubricant collecting passages 286 that are formed at the bottom of the crankcase 32. The lubricant collecting passages 286 are formed by the lower crankcase member 132 and a lower cover 288 that is secured to the lower crankcase member 132. The lubricant collecting passages 286 include openings 290*a–d* that are provided at the bottom of each of the crankcase chambers 119*a–d* and that extend through the lower crankcase member 132. The openings 290*a–d* communicate with transverse passages 292*a–d* that extend to a suction port 300. The transverse passages 292*a–d* are formed from grooves 294*a–d* located on the lower surface 296 of the lower member 132 and the top surface 298 of the lower cover 288. With this arrangement, the lubricant collecting passages 286 communicate with each cylinder. Accordingly, lubricant can be removed from the four cylinders.

The suction port 300 is connected to a suction pump 302. As best seen in FIGS. 3 and 8, the suction pump 302 is a positive displacement-type pump that is journaled to an end of the crankshaft 128 at the rear side of the hull 16. The suction pump 302 draws lubricant up from the lubricant collecting passages 286 and delivers the lubricant to a lubricant tank 304 through a lubricant passage 306, which is located inside the engine body 112, and a first lubricant pipe 308, which includes a negative pressure valve 309. The lubricant tank 304 is located at the rear of the engine 12.

With particular reference to FIG. 3, the first lubricant pipe 308 is connected to the top of the lubricant tank 304. The lubricant tank 304 includes a vapor separator 310, which includes a set of baffles 313. A first vapor pipe 312 is connected to the top of the lubricant tank 304. Vapors collected inside lubricant tank 304 are discharged through the first vapor pipe 312 to the intake system 160. Preferably, the first vapor pipe 312 includes a negative pressure valve 314.

A transfer pump 316 is located below the lubricant tank 304 and draws lubricant from the lubricant tank 304 through a second lubricant pipe 318. Preferably, the second lubricant pipe 318 also includes a negative pressure valve 309. The transfer pump 316 is a positive displacement-type pump that is journaled to the crankshaft 128 in an arrangement similar to the suction pump 302. The transfer pump 316 delivers lubricant to lubricant galleries provided in the engine body 112 for lubricating moving parts in the engine body 112. For example, lubricant is supplied to lubricant passages formed within the crankcase 118 for lubricating the crankshaft 128. Additionally, lubricant is supplied to lubricant galleries configured to guide lubricant to the camshafts 142, 146, the valves 136, 146, and the cylinder bores 120 (see FIG. 2). An oil filter 320 (see FIG. 2) is provided between the lubricant galleries and the transfer pump 316.

Blow-by vapors are removed from the lubrication system 284 and released into the intake system 160 through various vapor passages. For example, as mentioned above, vapors from the lubricant tank 304 are delivered to the intake system 160 through the first vapor pipe 312. Additionally, as shown in FIG. 3, a second vapor pipe 322 is connected to the valve cover 150 and the intake system 160. The second vapor pipe 322 preferably includes a negative pressure valve 314. The blow-by gases from the inside of the valve cover 150 are discharged through the second vapor pipe 322 to the intake system 160.

As such, the lubrication system 180 operates under the dry-sump lubrication principle, thus circulating lubricant through the engine 12 using a shallow lubricant pan and allowing the engine 12 to be mounted close to an inner surface of the lower hull section 18, as compared to engines employing wet sump type lubrication systems. This lowers the center of gravity of the watercraft 10. Of course, certain features, aspects and advantages of the present invention can be used in wet sump operations.

Figure 10:
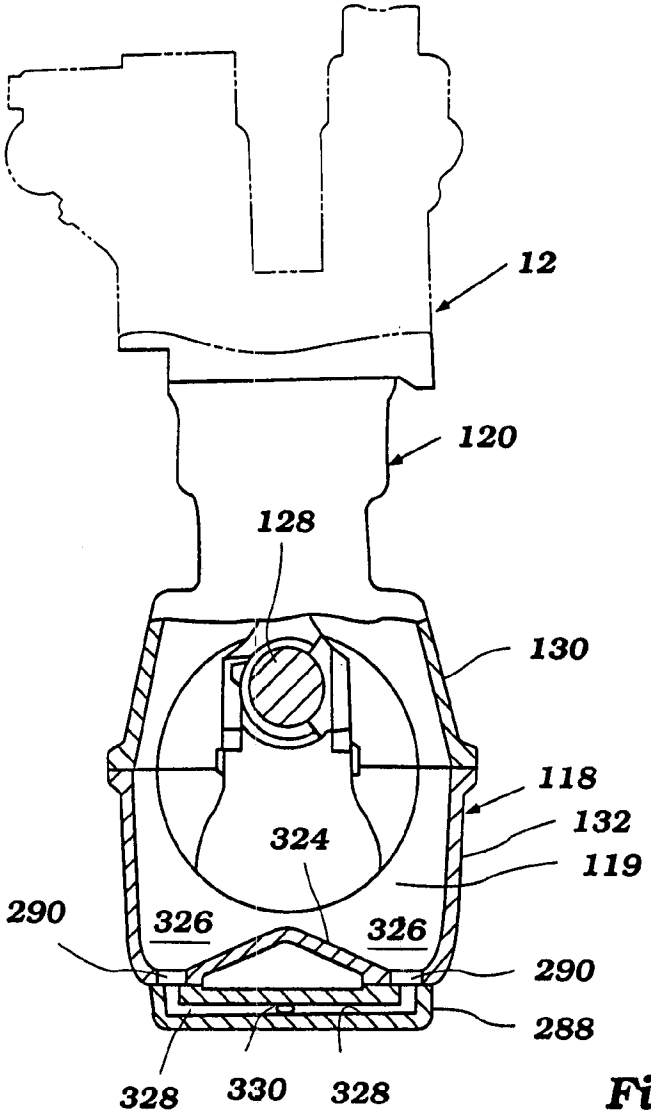
FIG. 10 is a partial cross-sectional view of a modified arrangement of the lower portion of the engine.
Figure 9:
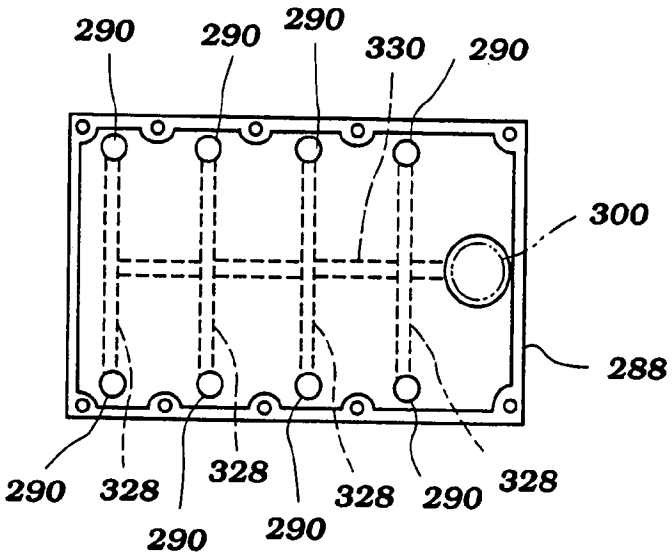
FIG. 9 is a top plan view of a modified arrangement of the lower cover.

FIGS. 9 and 10 illustrate a modified arrangement of the lubrication system 180. In this arrangement, a v-shaped lubrication guide 324 directs lubricant towards the sides 326 of the crankcase chamber 119. The openings 290 are located at the sides 326 and extend through the lower member 132 to lubricant connecting passages 328. The lubricant connecting passages 328 are connected to a transverse passage 330 that communicates with the suction port 300. This arrangement ensures that as the watercraft 10 rocks from side to side, lubricant can be continuously drained from the bottom of the crankcase chamber 119.

Figure 11:
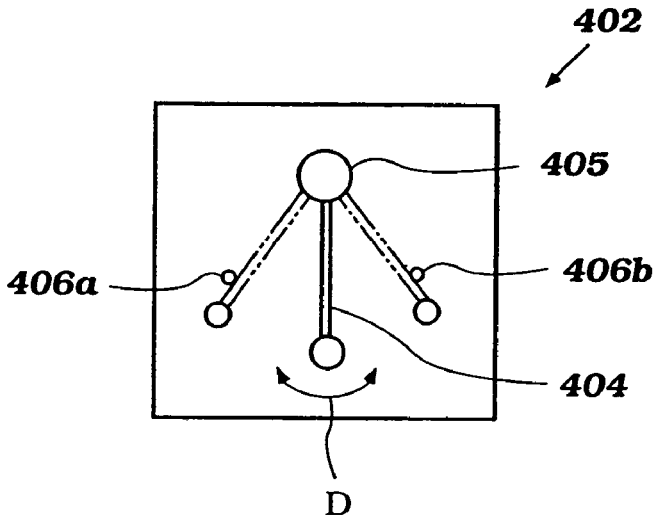
FIG. 11 is schematic illustration of an overturn switch.
Figure 12:
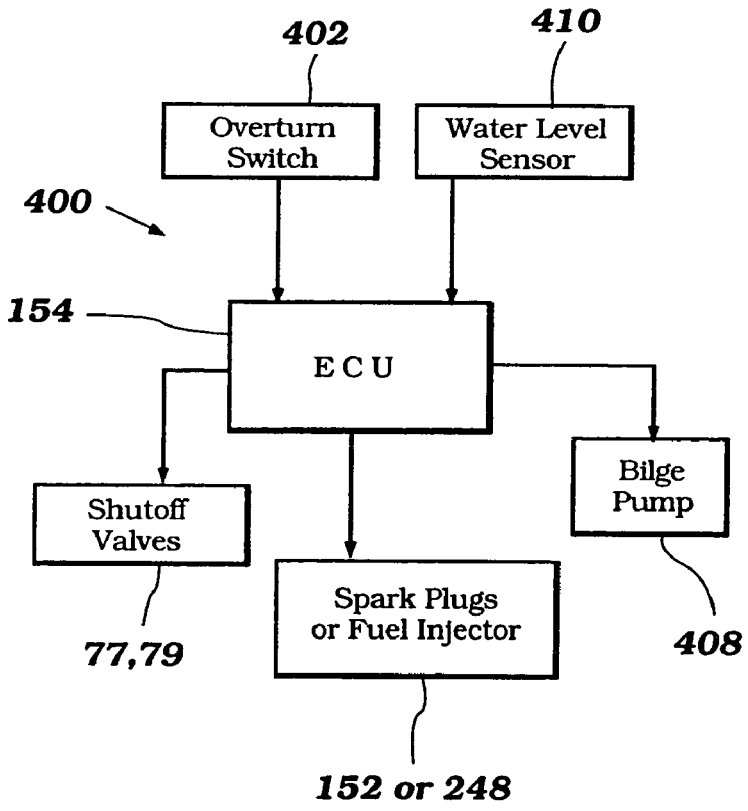
FIG. 12 is schematic illustration of an emergency stop system.

The watercraft 10 preferably includes an emergency shut-off system 400 that is illustrated schematically in FIG. 12. The emergency shut-off system 400 is configured to determine when the watercraft 10 is overturned. When the emergency shut-off system 400 determines that the watercraft 10 has overturned, the emergency shut-off system 400 is also configured to shut off the engine 12 and/or perform other functions that prevent water entering the engine compartment 44. As shown in FIG. 12, the emergency stop system 400 includes an overturn switch 24 (see FIG. 11), the ECU 154 (see also FIG. 1) and the forward rear intake shutoff valves 77, 79 that are located in the upper ends of the forward and rear intake ducts 76, 78 (see FIG. 1) and are controlled by the ECU 154.

FIG. 11 illustrates an arrangement of the overturn switch 402. The overturn switch 402 includes a pendulum 404 that is configured to pivot about an axis 405. When the watercraft 10 is overturned, the pendulum 404 pivots, as indicated by the arrow D, and rests against the right or left stopper 406*a*, 406*b*. When the pendulum 404 contacts one of the stoppers 406*a*, 406*b*, the overturn switch 402 sends a signal to the ECU 154.

The emergency shut-off system 400 includes methods and apparatus for determining if the watercraft 10 is overturned from the signal generated by the overturn switch 402. In particular, the emergency shut-off system includes subroutines that determine when the watercraft 10 is overturned from the signal generated by the overturn switch 402. It should be noted that the ECU 154, which performs these subroutines, may be in the form of a hard wired feed back control circuit that performs the subroutines describe below. Alternatively, the ECU 154 can be constructed of a dedicated processor and memory for storing a computer program configured to perform the steps described below. Additionally, the ECU 154 can be a general purpose computer having a general purpose processor and the memory for storing a computer program for performing the steps and functions described below.

In one subroutine, the emergency shut-off system 400 is initialized, preferably when an ignition starting device (e.g., a key activated switch) is activated. Once initialized, the emergency shut-off system 400 determines if the overturn switch 402 is generating a signal. If a signal is not being generated, the emergency shut-off system 400 continues monitoring for a signal from the overturn switch 402. If a signal is being generated, the emergency shut off system 400 then determines if the signal continues for a predetermined amount of time or a "preset delay" (e.g., several seconds). If the signal does not continue for the predetermined amount of time, the emergency shut off system 400 determines that the watercraft 10 has not been overturned. In such a situation, the emergency shut-off system 400 continues monitoring for a signal from the overturn switch 402. If the signal does continue for the predetermined amount of time, the emergency shut-off system 400 determines that the watercraft 10 has overturned. The emergency shut-off system 400 then performs certain functions to prevent water from damaging the engine 12 as will be describe in more detail below.

The emergency shut-off system 400 can be arranged in several different ways to determine if the signal from the overturn switch 402 continues for the predetermined amount of time. For example, the emergency shut-off system 400 can be configured such that the signal from the overturn switch 400 must be continuous or substantially continuous during the predetermined time period. In a modified arrangement, the emergency shut-off system 400 can be configured to determine if the signal from the overturn switch is merely being generated before and after the predetermined time period.

An advantage of the subroutine described above is that the emergency shut-off system 400 does not determine that the watercraft 10 is overturned if the watercraft 10 is merely turning abruptly or rocking back and forth quickly. In such situations, the pendulum 404 contacts the stoppers 406*a*, 406*b* for a short period of time. Accordingly, the signal generated by the overturn switch 402 do not continue for a time period greater than the predetermined time.

When the emergency shut off system 400 determines that the watercraft 10 is overtured, the emergency shut-off system 400 stops the engine 12. Preferably, this is accomplished by stopping the supply electricity to the spark plugs 154 or by closing the fuel injectors 248. As such, in some embodiments, the solenoids of the fuel injectors 248 can be controlled so as to interrupt the supply of fuel, and thereby stop the engine 12. The emergency stop system 400 also preferably closes the forward rear intake shutoff valves 77, 79 of the forward and rear intake ducts 76, 78. This further prevents water from entering the engine compartment.

As shown in FIG. 12, the emergency control system 400 also preferably includes an electric bilge pump 408 (see also FIG. 1) that is controlled by the ECU 154. When the emergency stop system 400 detects that the watercraft 10 is overturned or overturned for a predetermined amount of time and then returned to an upright position, the emergency stop system 400 preferably activates the bilge pump 408. The bilge pump 408 is configured to remove water from the hull 16 and preferably to deliver it to a low pressure part of the jet propulsion unit 90. Accordingly, water that accumulates in the hull 16 while the watercraft 10 is overturned can be removed.

Figure 13:
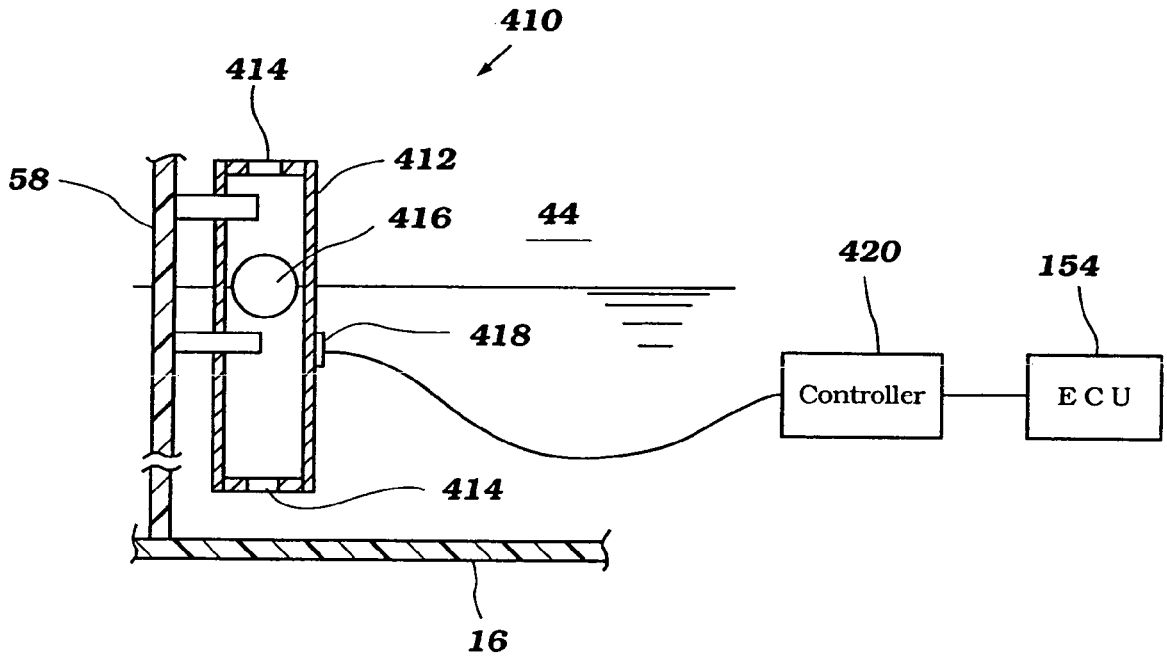
FIG. 13 is a cross-sectional view of a water level detection sensor.
Figure 14:
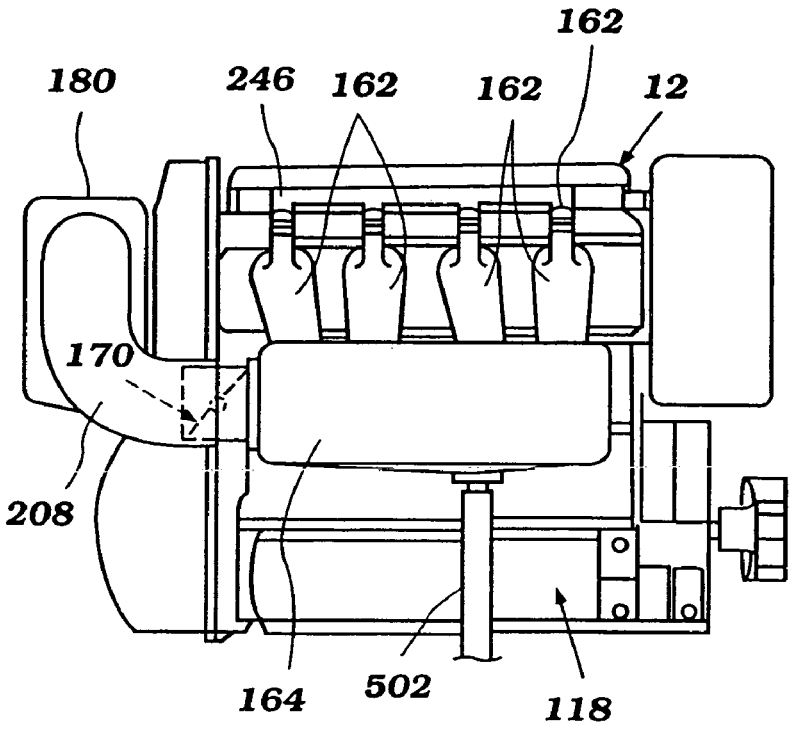
FIG. 14 is a left side view of a modified arrangement of an intake system of the engine.
Figure 15:
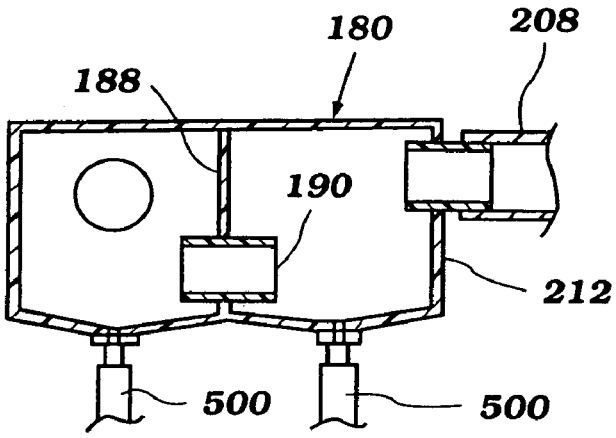
FIG. 15 is a cross-sectional view of an intake silencer of the modified intake system.

With reference now to FIG. 11, the emergency shut-off system 400 also preferably includes a water level detection sensor 410 that is connected to the ECU 154 and illustrated in FIG. 13. The water level sensor 410 is configured to detect when water in the engine compartment 44 exceeds a predetermined level (e.g., when the water level exceeds a height of an impeller shaft of the jet propulsion unit 98). As shown in FIG. 13, the illustrated water level sensor 410 includes a cylindrical body 412 that preferably is mounted to a bulkhead 58 near the lower hull 16 in the engine compartment 44. The cylindrical body 412 includes openings 414 that allow water that has accumulated in the engine compartment 44 to enter the cylindrical body 412. A buoy 416 is positioned in the cylindrical body 412 and is freely movable in a vertical direction. A positional detection sensor 418, such as, for example, a magnetic force sensor or infrared sensor, detects the position of the buoy 416 and is connected to the ECU 154 through a sensor controller 420.

When water is accumulated in the engine compartment 44, the buoy 416 begins to rise in the cylindrical body 412. When the buoy 416 reaches the level of the positional detection sensor 418, the sensor 418 sends a signal through the controller 420 and to the ECU 154. When such a signal is received by the ECU 154, the emergency shut-off system 400 stops the engine 12. In addition, the emergency start system 400 preferably starts the bilge pump 408, thereby removing the water from the hull 16. The emergency shut-off system 400 preferably also prevents the engine 12 from being restarted until the water level inside the engine compartment 44 is lower than a predetermined level. It is anticipated that at least two activation levels can be incorporated such that the bilge pump can be controlled (on/off or speed) before the level that results in stopping the engine is reached.

When the watercraft 10 is overturned and the engine 12 is shut off by the emergency stop system 400, the pressure in the intake system 160 is no longer negative. Accordingly, the negative pressure valves 314 in the vapor pipes 312, 322 close when the watercraft 10 is overturned. This arrangement prevents lubricant from the lubricant tank 304 and the valve cover 150 from flowing into the intake system 160. In a modified arrangement, the negative pressure valves 314 can be electronic valves 314 that are controlled by the ECU 154. In such an arrangement, the emergency shut-off system 400 can be configured to shut the electronic control valves when the emergency shut-off system 400 determines that the watercraft 10 has overturned. Preferably, the valves are designed to be normally closed such that the valves close when power is removed.

In a similar manner, when the watercraft 10 is overturned and the engine 12 is shut off, the negative pressure valves 309 in the first and second lubricant pipes 308, 318 are closed. These valves 309 prevent the back flow of lubricant from the transfer pump 316 to the lubricant tank 304 and from the lubricant tank 304 to the suction pump 302. This arrangement allows the lubricant to be stored in the transfer pump 316 when the engine 12 is shut off. Accordingly, lubricant is quickly and smoothly delivered to the engine 12 when the engine 12 is restarted. In a modified arrangement, the negative pressure valves 309 can be electric valves 309 that are closed by the emergency shut-off system 400 when the watercraft 10 is overturned. As such, in some embodiments, one or more of the valves 309 can be closed if the overturn switch 402 has generated a signal for at least a present amount of time.

In a modified arrangement of the emergency stop system 400, the overturn switch 402 comprises an lubrication system pressure sensor. When the watercraft 10 is overturned, only a small amount of lubricant is discharged from the transfer pump 316. Accordingly, the lubrication pressure inside the lubrication system 284 dramatically drops. The emergency shut-off system 400 can be configured to shut off the engine 12 when such a dramatic drop in the lubrication system 284 is detected. In an additional arrangement, the overturn switch 402 comprises an engine compartment pressure sensor that detects the air pressure inside the engine compartment 44. When the watercraft 10 is overturned, air cannot enter the engine compartment 44. However, if the engine 12 is still running, the air in the engine compartment 44 is consumed and the air pressure drops. The emergency shut-off system 400 can be configured to shut off the engine 12 when such a pressure change is detected in the engine compartment.

Figure 16:
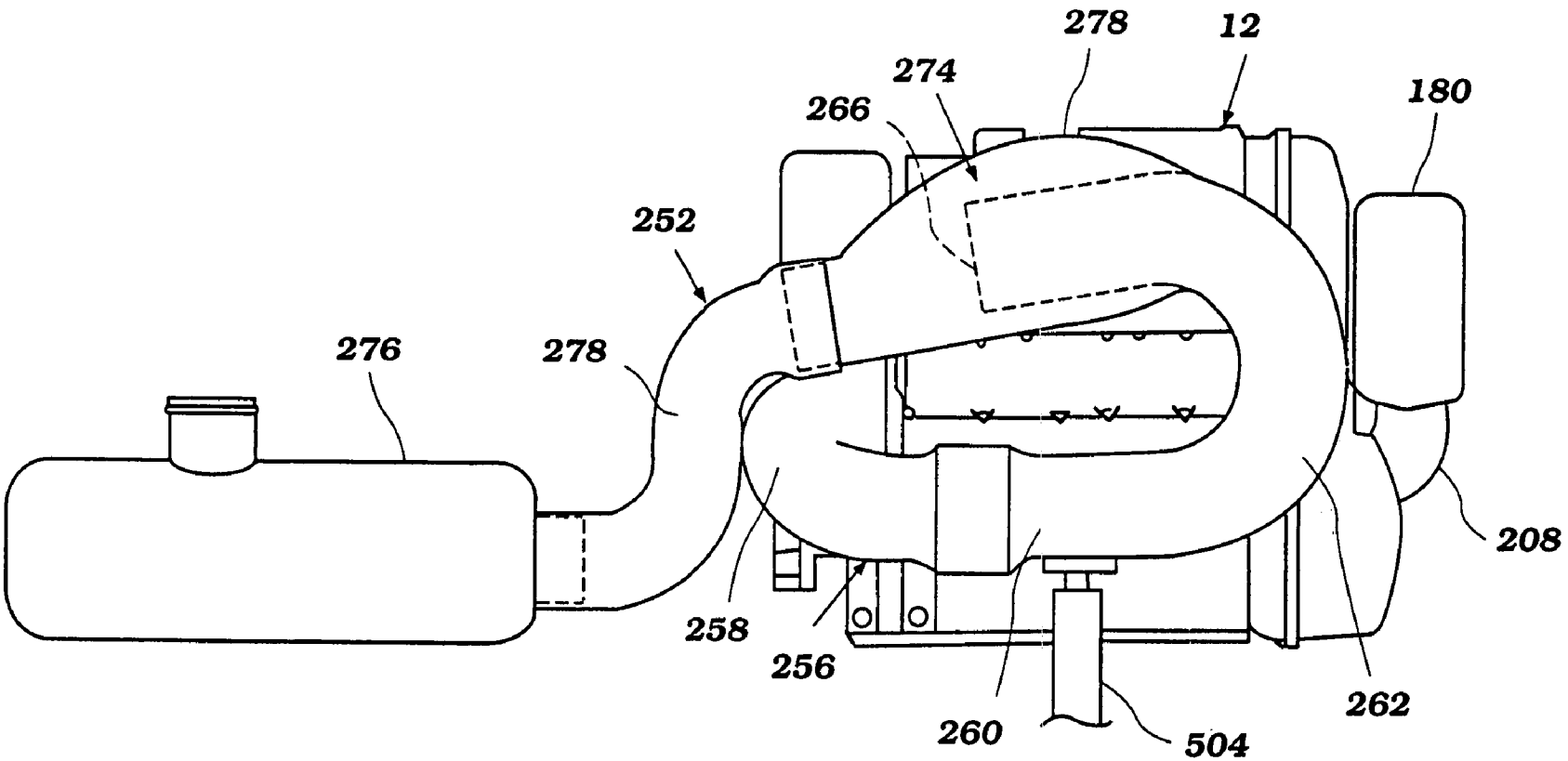
FIG. 16 is a right side view of a modified exhaust system.

FIGS. 14–17 illustrate a modified arrangement of the intake system 160. In this arrangement, the one-way valves 167, 198 (see FIG. 3) in the intake silencer 180 and the intake chamber 164 are replaced by drain hoses 500, 502 (see FIGS. 14 and 15). In addition, as shown in FIG. 16, a drain hose 504 is connected to the bottom of the exhaust pipe 256.

Figure 17:
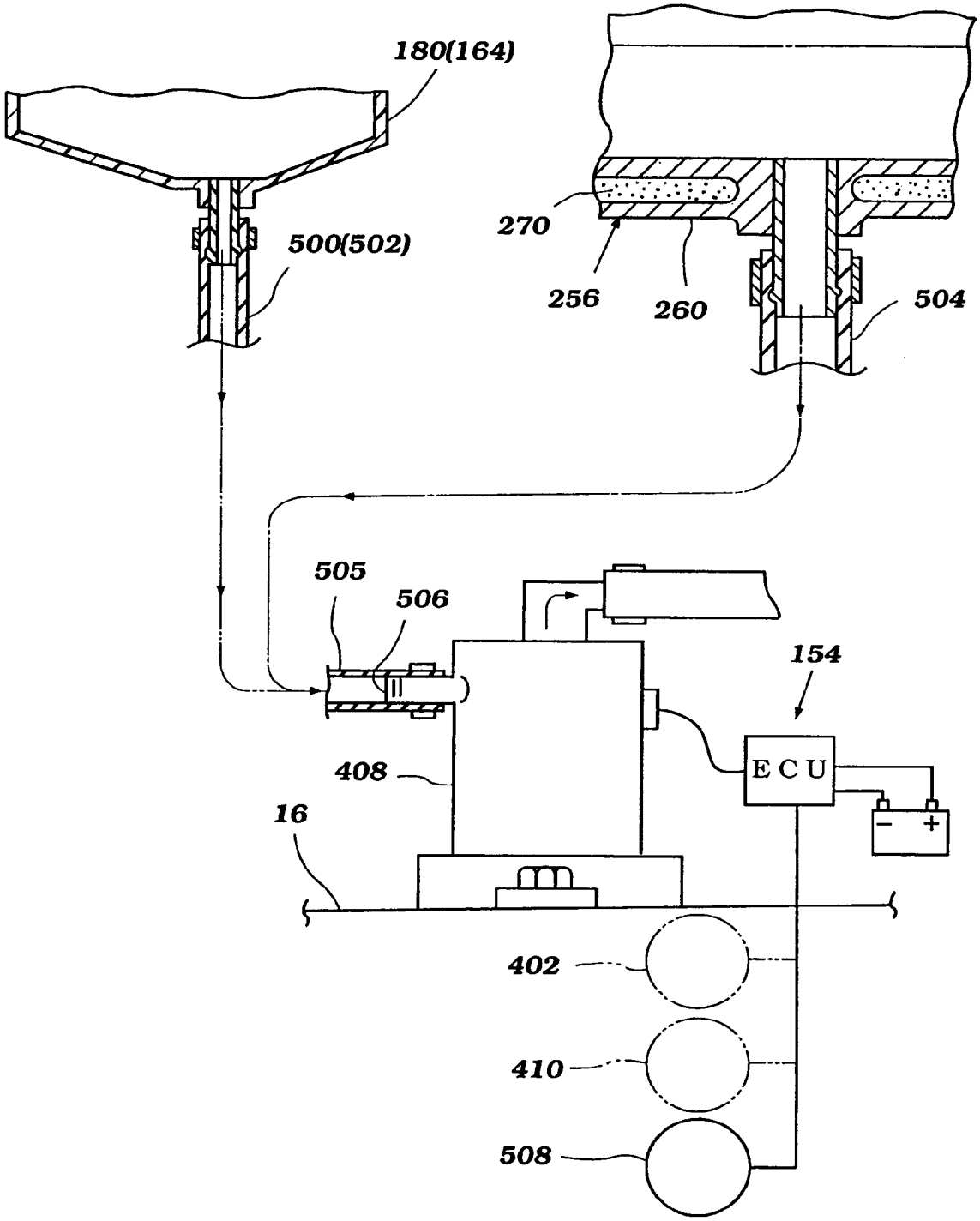
FIG. 17 is a schematic illustration of a control system for the modified intake and exhaust cooling systems.

As shown in FIG. 17, the drain hoses 500, 502, 504 are connected to a suction port 506 of the bilge pump 408. The bilge pump 408 is controlled by the ECU 154, which is connected to a water detection sensor 508 in addition to the overturn switch 402 and the water level sensor 410. The water detection sensor 508 detects when water has accumulated inside the intake chamber 164, intake silencer 180, and/or the exhaust pipe 256. In one arrangement, the water detection sensor 508 comprises individual water detection sensors located in each of the drain hoses 500, 502, 504. In a modified arrangement, the water detection sensor 508 comprises individual water detection sensors 508 located at the bottom of the intake silencer 180, intake chamber 164, and exhaust pipe 256. In the preferred embodiment, the water detection sensor comprises a single water detection sensor located in the bilge pump 408 or in a common hose 505 that communicates with each of the drain hoses 500, 502, 504.

When the ECU 154 receives a signal from the water detection sensor 508 indicating that water is present in the intake chamber 164, intake silencer 180, and/or the exhaust pipe 256, the ECU 154 sends a control signal to the bilge pump 408 to drain the accumulated water from the intake chamber 164, intake silencer 180, and/or the exhaust pipe 256. This arrangement further ensures that water does not enter the engine 12 through the intake system 160 and/or the exhaust system 252. Preferably, the ECU 154 is also configured to drive the bilge pump 408 when the overturn switch 402 detects that the watercraft 10 has overturned or when the water level sensor 410 detects that water has accumulated inside the engine compartment 44.

As discussed above, FIG. 18 illustrates a modified arrangement of the engine 12, the intake system 160 and the fuel system. In this arrangement, a cylinder axis CA of the engine 12 is inclined at an angle F to the left side of the watercraft 10. The intake system 160 includes carburetors 552 that are connected to the intake passages 138 and cylinder head 114 through corresponding joints 554. The upstream side of the carburetors 552 are connected to the intake chamber 164 by the intake pipes 162. The intake pipes 162 are connected to the intake silencer 180 by the intake duct 208 as in the previous arrangements.

Preferably, in this arrangement, the carburetors 552 are inclined upwardly. The intake pipes 162, therefore, extend laterally to the left from the carburetors 552 and then extend downwardly. To connect to the intake chamber 164, the intake pipes 162 bend to the right and then extend laterally and downwardly to the intake chamber 164. The inlets 166 of the intake pipes 162 are spaced from the inner surface of the intake chamber 164. In this arrangement, water may enter the carburetor 552 will tend to flow downwardly toward the intake chamber 164 due to the downward incline of the carburetor 552.

The inclined nature of the engine 12 makes more space available for the exhaust system 252. Accordingly, the expansion chamber 264 can be made larger with a greater angle of curvature. This reduces the exhaust resistance and increases engine 12 output power. Additionally, the inclined engine 12 enables the watercraft 10 to have a lower center of gravity, thus improving stability.

Figure 19:
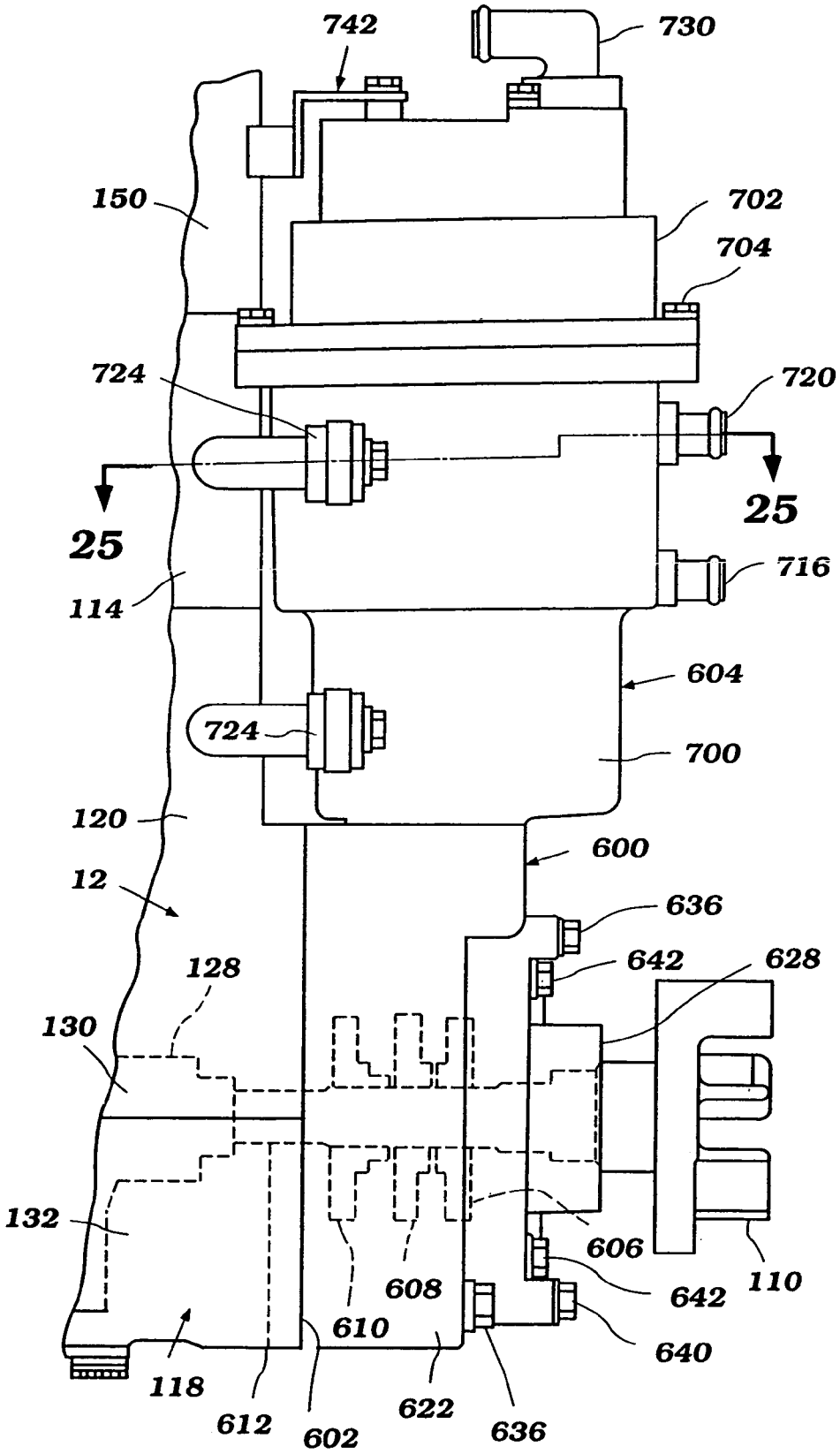
FIG. 19 is a side view of a modified arrangement of a pump unit and lubrication tank.

FIGS. 19–25 illustrate a modified arrangement of the lubrication system 284. As shown in FIG. 19, a pump unit 600 is mounted at a rear surface 602 of the crank case 118. An oil tank 604 that is preferably made of an aluminum alloy is mounted above the pump unit 600.

Figure 20:
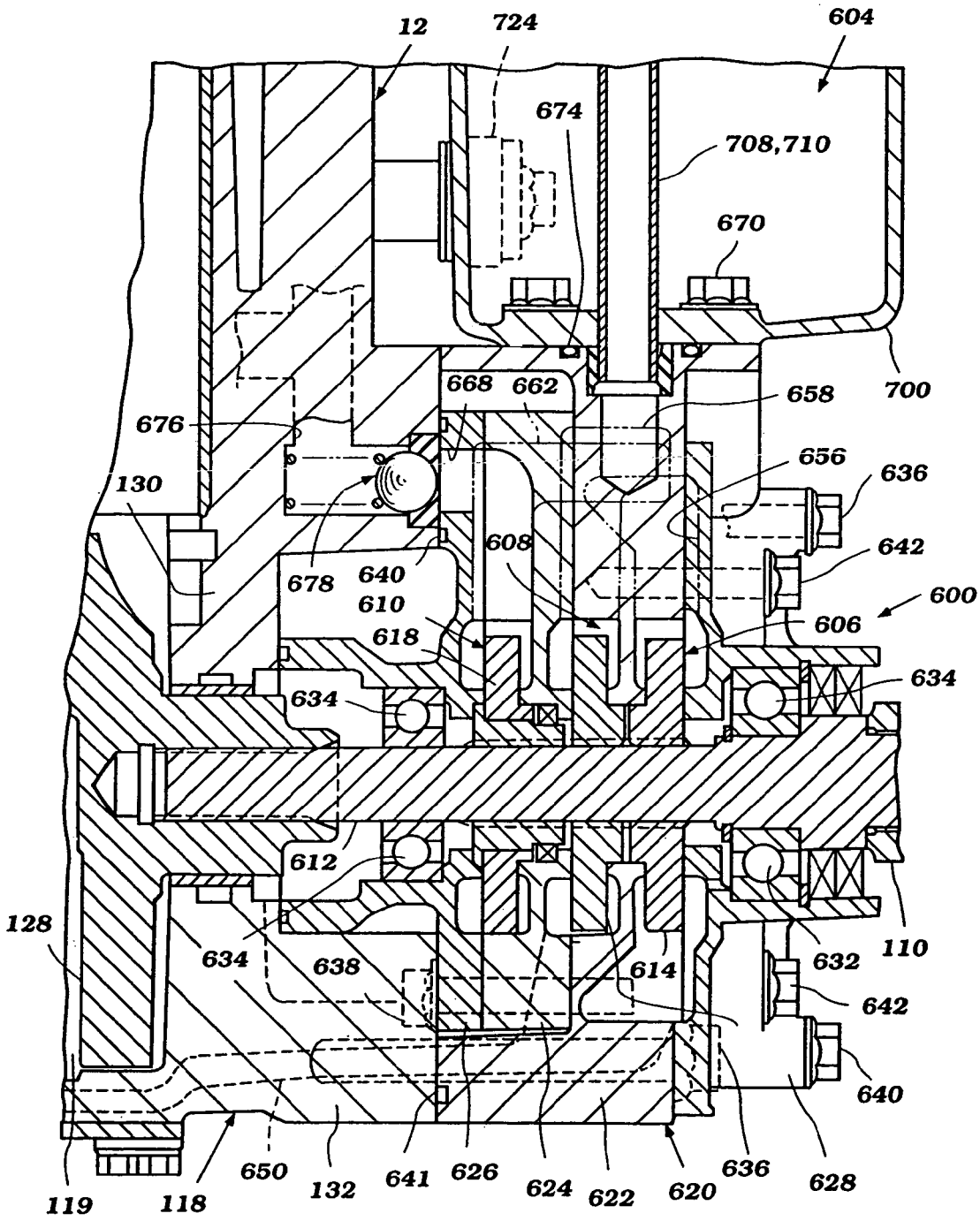
FIG. 20 is a side cross-sectional view of the pump unit.

As best seen in FIG. 20, the pump unit 600 is comprised of a first suction pump 606, a second suction pump 608 and a lubricant transfer pump 610. Each of the pumps, 606, 608, 610 are generally axially aligned and are journaled to a pump shaft 612, which is splined to the rear of and is co-axial with the crankshaft 128. In the illustrated arrangement, the first suction pump 606 is situated furthest from the crankshaft 128 and the lubricant transfer pump 610 is situated closest to the crankshaft 128. The second suction pump 608 is located between the first suction pump 606 and the transfer pump 610.

The pumps 606, 608, 610 are trochoidal pumps. Accordingly, they include rotors 614, 616, 618 that are secured to and rotate with pump shaft 612. The rotors 614, 616, 618 are enclosed by a pump housing 620.

The pump housing 620 is comprised of an outer housing 622 that is secured to the crankcase 118. The outer housing 622 forms an outer periphery of the pump unit 600. The pump housing 620 also includes an inner housing 624 and an inner cover 626 that is secured inside the outer housing 622. A pump cover 628 is secured to the rear side 630 of the outer housing 622. The pump shaft 612 is rotatably supported in the pump cover 628 and the inner cover 626 through bearings 632 and 634.

The pump unit 600 is assembled by securing the outer housing 622 to the crank case 118 with a bolt 636. The inner housing 624 and inner cover 626 also are secured to the outer housing 622 with a bolt 638. A seal member 641 lies between the inner cover 626 and the crank case 118 and prevents substantial leakage. A bolt 642 also secures the pump cover 628 to the outer housing 622.

With continued reference to FIG. 20, the pump housing 620 defines lubricant collecting passages 650. The lubricant collecting passages 650 communicate with the crankcase chamber 119, preferably in a manner similar to the arrangements illustrated in FIG. 8 or FIGS. 9 and 10.

Figure 22:
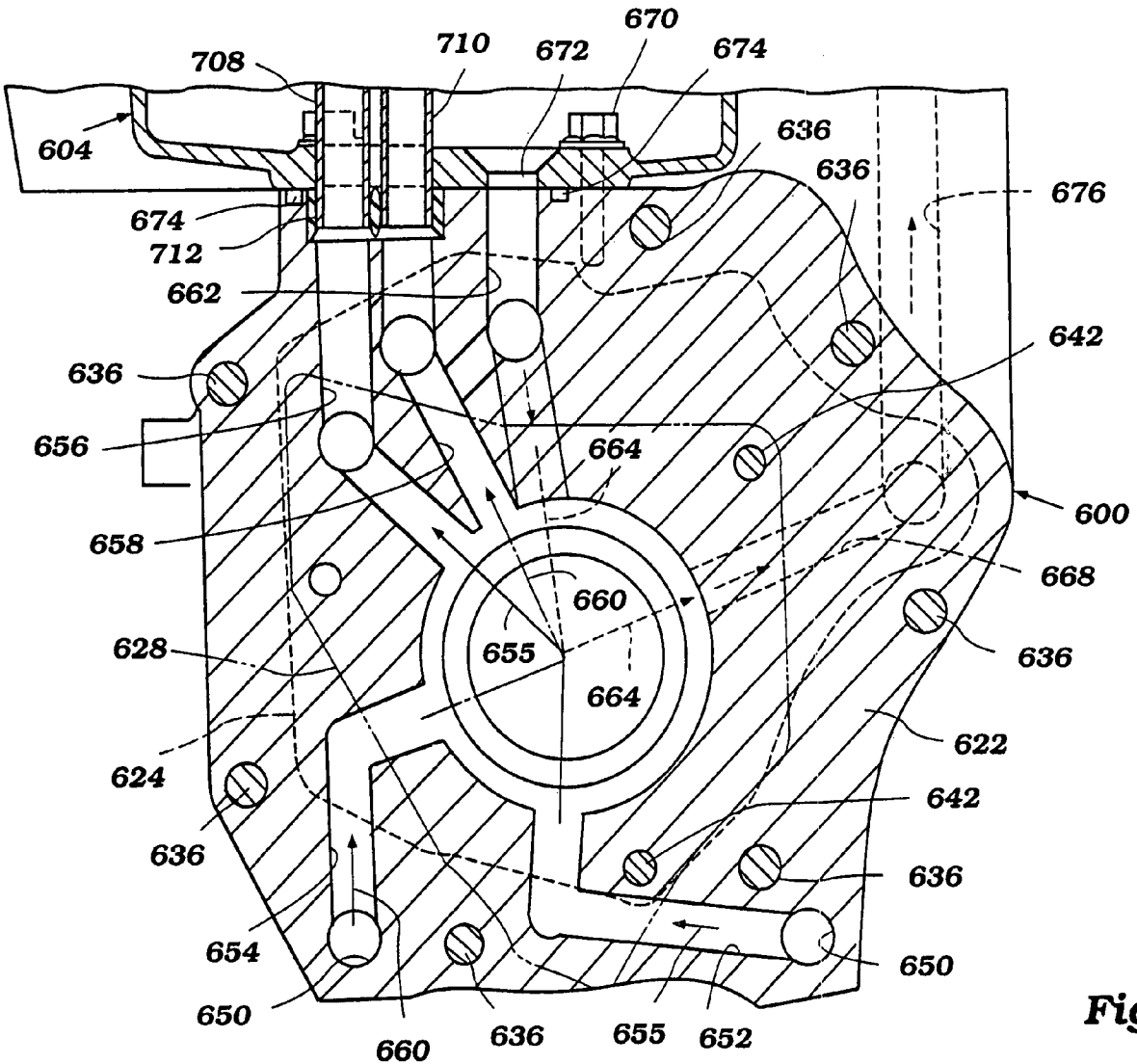
FIG. 22 is a front cross-sectional view of the pump unit.

As shown in FIG. 22, one of the lubricant collecting passages 650 is connected to a first inlet passage 652 that is also defined by the pump housing 620. A second lubricant collecting passage 650 is connected to a second inlet passage 654, which also is defined by the pump housing 620.

As indicated by the solid arrow 655, the first suction pump 606 draws lubricant from the collecting passage 650 and the first inlet passage 652 and delivers the lubricant to a first outlet passage 656. Similarly, the second suction pump 608 draws lubricant through the second inlet passage 654 and delivers it to a second outlet passage 658, as indicated by the alternate long and short dashed line 660. A third inlet passage 662 communicates with the lubricant tank 604 and the transfer pump 610. As indicated by short dashed lines 664, the transfer pump 610 delivers lubricant from the third inlet passage 662 to a third outlet passage 668, which is also defined by the pump housing 622.

The lubricant tank 604 is secured to the outer housing 622 by mounting bolts 670. The third inlet passage 662 is connected an outlet opening 672 in the lubricant tank 604. Sealing members 674 between the outer housing 622 and the lubricant tank 604 generally prevent the lubricant from leaking past the connection between the third inlet passage 662 and the outlet opening 672.

The third outlet passage 668, which is connected to the transfer pump 610 and the third inlet passage 662, communicates with an engine lubrication passage 676. As shown in FIG. 20, a spring biased ball check valve 678 is located between the engine lubrication passage 676 and the transfer pump 610. This arrangement generally prevents the lubricant inside the lubricant tank 604 from draining towards the engine 12 when the engine 12 is shut off.

As shown in FIGS. 20–25, the lubricant tank 604 is comprised of a body 700 that is secured in the pump unit 600 by the mounting bolts 670 and a lid 702 that is secured by bolts 704 to the top of the tank body 700. The lubricant tank 604 also includes a vapor separator 706 that is located inside the tank body 700 and connection pipes 708 and 710 that extend through the tank body 700. The connection pipes 708, 710 are connected to the first and second outlet passages 656, 658, as best seen in FIG. 22. The connection is sealed by sealing ring 712.

Figure 21:
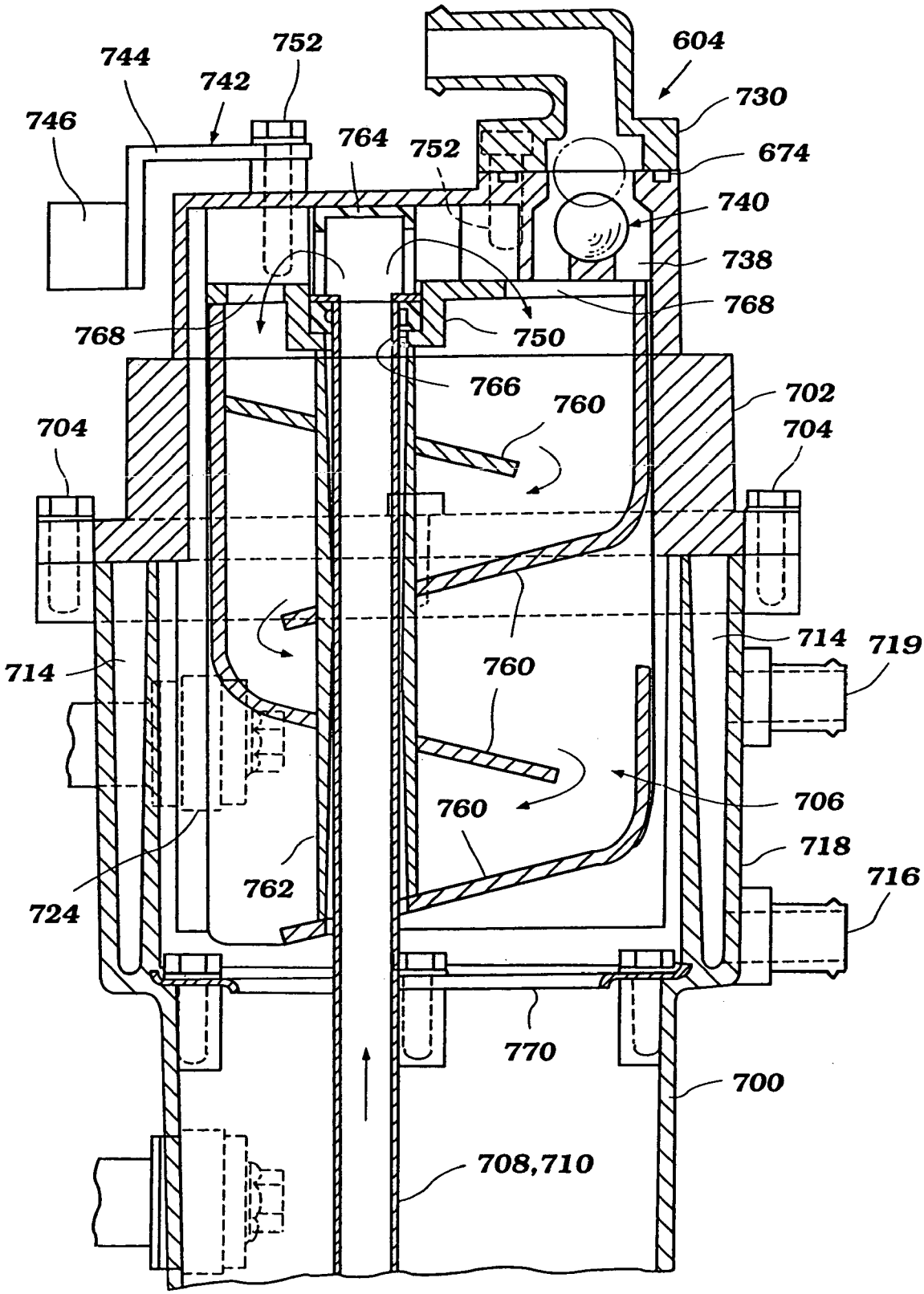
FIG. 21 is a side cross-sectional view of the lubrication tank.

As shown in FIG. 21, the tank body 700 has a coolant passage 714 in its upper side. The coolant passage 714 encircles the upper side of the tank body 700 (see also FIG. 25). Coolant is supplied from the cooling system through a coolant hose coupling member 716 located on the rear wall 718 of the tank body 700. The coolant is discharged from another coolant hose coupling member 719 that is also located on the rear wall 718.

Figure 23:
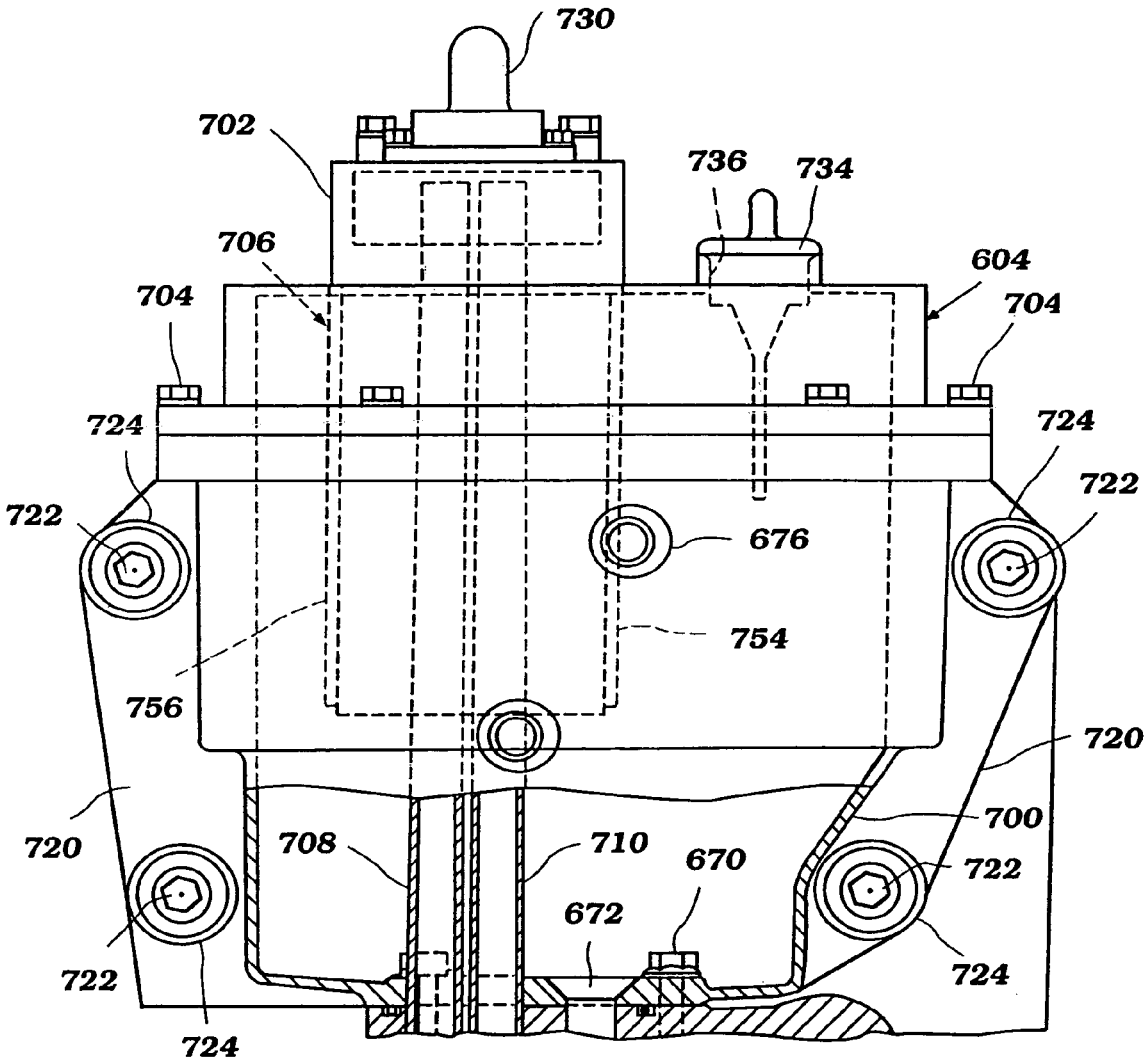
FIG. 23 is a rear view of the lubrication tank (i.e., viewed from a rear side of the watercraft)
Figure 24:
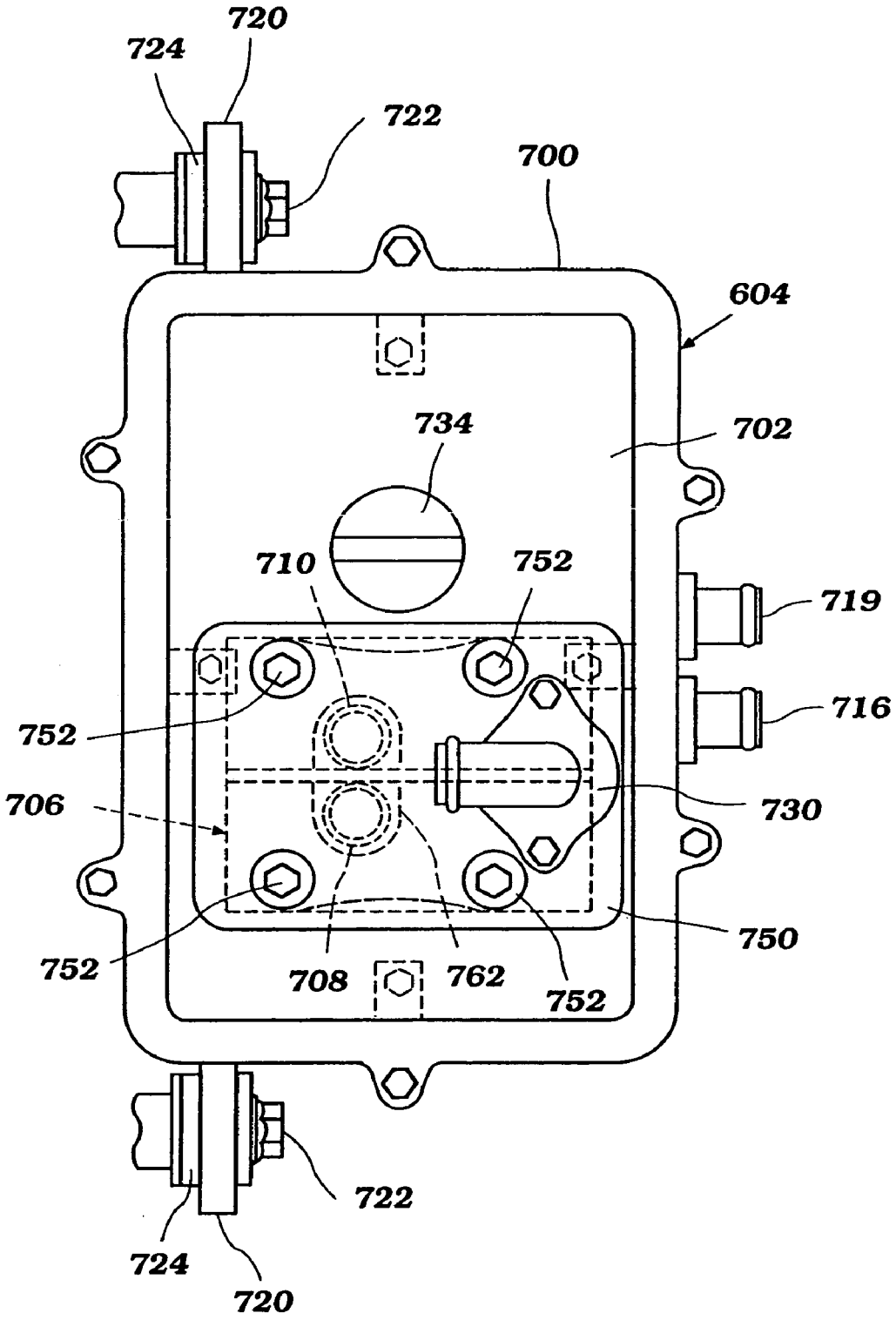
FIG. 24 is a top plan view of the lubrication tank.

As shown in FIGS. 23 and 24, the tank body 700 includes brackets 720 that are mounted in the cylinder body 120 and cylinder head 114 through mounting bolts 722 with rubber cushions 724. Preferably, the tank body 700 is mounted with two mounting bolts 722 on each side of the tank body 700.

With continued reference to FIG. 23, the lid 702 closes an upper opening of the tank body 700. The lid 702 includes a ventilation hose coupling member 730 and lubricant cap 734 with an integral lubricant level gauge. The lubricant cap 734 closes the lubricant filling port 736. The ventilation hose coupling member 730 is coupled to a hose (not shown) for delivering vapors inside the lubricant tank 604 to the intake system 160.

As best seen in FIG. 21, the coupling member 730 is connected to the lubricant tank 604 by a communication passage 738 formed in the lid 702. In the illustrated arrangement, a ball-type check valve 740 is positioned in the communication passage 738 for preventing the passage of lubricant into the intake system 160 from the lubricant tank 604. The connection between the coupling member 730 and the communication passage 738 is sealed by a sealing member 674.

The lid 702 of the lubrication tank 604 includes a damping member 742. The damping member 742 includes an arm 744 that projects from the lid 702 and a flat plate 746 that extends vertically from the tip of the arm 744. The flat plate 746 faces a stopper surface (not shown) formed in the cylinder head cove 150 (see also FIG. 19). Accordingly, the damping member 742 restricts rocking movement of the lubricant tank 604 in the longitudinal and transverse directions relative to the engine 12. However, the damping member 742 does not restrict the movement of the lubricant tank 604 in the vertical direction.

Figure 25:
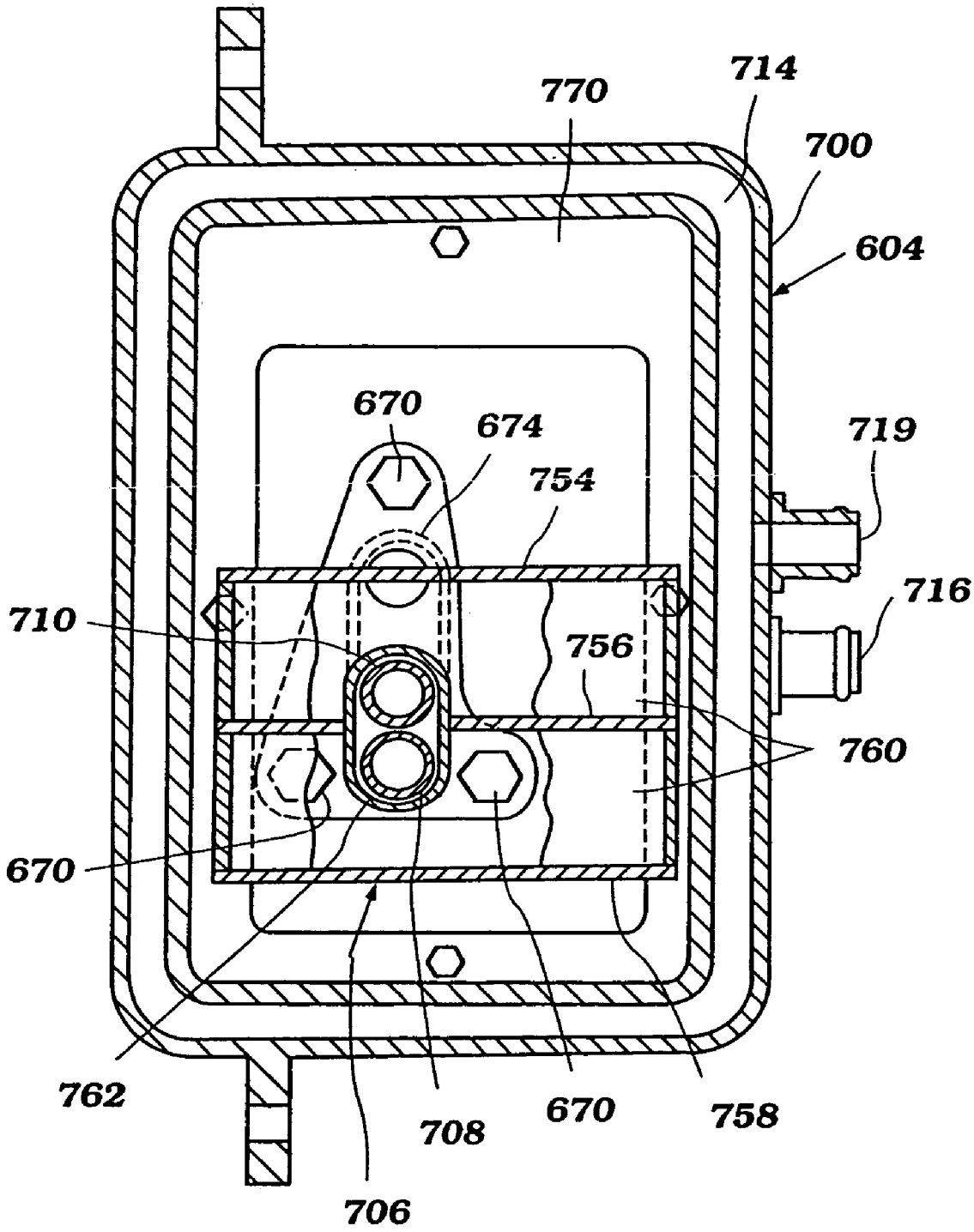
FIG. 25 is a top cross-sectional view of the lubrication tank taken along line 25—25 of FIG. 19.

With reference to FIG. 21, the vapor separator 706 is configured to remove vapors contained in the lubricant delivered from the first and second suction pumps 606, 608 through the connection pipes 708, 710. The vapor separator 706 is comprised of an upper lid 750 that is secured by bolts 752 to the upper side of the lid 702 (see also FIG. 24). As best seen in FIG. 25, the vapor separator 706 also includes three vertical plates 754, 756, 758 that extend downwardly from the upper lid 750. The vapor separator 706 further includes panels 760 that form a lubrication passage between the vertical plates 754–758 (FIG. 25). A pipe 762 penetrates the panels 760 and the middle vertical wall 756. The pipe 762 surrounds the connection pipes 708, 710.

The upper lid 750 supports the upper ends of the connection pipes 708, 710 and a press member 764 that is clamped between the lid 702. The connection pipes 708, 710 are inserted through holes 766 that are formed in the middle of the upper lid 750. Lubricant ports 768 are provided at the sides of the upper lid 750. The lubricant ports 768 guide lubricant from the connection pipes 708, 710 towards the vapor separator 706.

A dividing plate 770 is provided in the lower portion of the lubricant tank 604 for reducing waves while the watercraft 10 is running. As shown in FIG. 25, the dividing plate 770 has a generally square shape in the top plan view and is secured in the tank body 700.

The lubrication system as described with reference to FIGS. 19–25 has several advantages. For example, the pump unit 600 is located in a dead space (see FIG. 19) formed between the coupling 110 and the crank case 118. Accordingly, the pump unit 600 can utilize a plurality of lubricant pumps with minimal or no effect on the size of the engine 12.

Another advantage is that the lubricant tank 604 is directly mounted to the upper side of the pump unit 600. The space above the pump unit 600 can therefore be used to increase the size of the lubricant tank 604.

Still yet another advantage is that the connection pipes 708 and 710 are located inside the lubricant tank 604. This arrangement is simpler and takes up less space than an arrangement where the pipes are located outside the lubricant tank 604.

Of course, the foregoing description is that of certain features, aspects and advantages of the present invention to which various changes and modifications may be made without departing from the spirit and scope of the present invention. Moreover, a watercraft may not feature all objects and advantages discussed above to use certain features, aspects and advantages of the present invention. Thus, for example, those skilled in the art will recognize that the invention may be embodied or carried out in a manner that achieves or optimizes one advantage or group of advantages as taught herein without necessarily achieving other objects or advantages as may be taught or suggested herein. The present invention, therefore, should only be defined by the appended claims.

What is claimed is:

1. A method of disabling combustion in an engine of a watercraft that includes a hull having an undersurface that defines a planing surface configured to support a weight of the watercraft when operated in a planing mode, the hull also defining an engine compartment, the engine defining at least one cylinder and being supported within the engine compartment and including at least one cylinder, the watercraft also including a sensor configured to detect a tilting motion of the hull and to emit a signal corresponding to the tilting motion, the method comprising:

determining if the sensor has emitted the signal for at least a predetermined time;

disabling combustion in the cylinder if the sensor has emitted the signal for at least the predetermined time; and closing one or more valves that are positioned within a lubrication system of the engine, if the sensor has generated a signal for at least the predetermined time.

2. A method as in claim 1, further comprising combusting an air/fuel mixture in the cylinder when the sensor is not emitting the signal.

3. A watercraft comprising a hull defining a planing surface configured to support the watercraft when operated in a planing mode, an internal combustion engine supported within the engine compartment and including at least one cylinder, a fuel supply system configured to deliver fuel to the cylinder for combustion therein, an ignition system configured to ignite a fuel/air mixture in the cylinder, at least one capsize sensor configured to detect a tilting motion of the hull and to emit a signal corresponding to the tilting motion, a controller configured to generate and direct fuel control and ignition control signals to the fuel and ignition systems, respectively, the controller being further configured to manipulate at least one of the fuel and ignition control signals to disable combustion in the cylinder only if the capsize sensor has emitted the signal substantially continuously for a predetermined amount of time; wherein the fuel system comprises a fuel injector having a solenoid-driven valve and configured to inject fuel for combustion in the cylinder, the controller being configured to control the solenoid so as to interrupt fuel supply and thus stop the engine if the capsize sensor has emitted the signal for the predetermined time.

4. The watercraft as set forth in claim 3 additionally comprising a seat pedestal defined by the hull and configured to support an operator of the watercraft, the engine being supported by the hull within the seat pedestal.

5. The watercraft as set forth in claim 4 additionally comprising a seat supported by the seat pedestal, the seat being configured to be straddled by an operator of the watercraft.

* * * * *

UNITED STATES PATENT AND TRADEMARK OFFICE

CERTIFICATE OF CORRECTION

PATENT NO. : 7,182,656 B2
APPLICATION NO. : 10/717034
DATED : February 27, 2007
INVENTOR(S) : Masayoshi Nanami et al.

It is certified that error appears in the above-identified patent and that said Letters Patent is hereby corrected as shown below:

On the title page: Item (75) Inventors: Please delete "N boru Suganuma: and insert -- Noboru Suganuma--.

Item [56] Col. 2 (U.S. Patent Documents), line 9, after "Tsunamoto et al." insert -- 340/521 --.

Page 2 Col. 1 (U.S. Patent Documents), line 2, after "Nitta et al." insert -- 440/1 --.

Column 1, line 39, delete "consequences-typically" and insert -- consequences typically --, therefor.

Column 3, line 45, delete "sensor," and insert -- sensor; --, therefor.

Column 4, line 9, (Approx.), delete "watercraft" and insert -- watercraft --, therefor.

Column 4, line 28, (Approx.), delete "stem" and insert -- stern --, therefor.

Column 4, line 48, (Approx.), delete "stem" and insert -- stern, --, therefor.

Column 5, line 46, delete "fiberglass reinforced" and insert -- fiberglass-reinforced --, therefor.

.

UNITED STATES PATENT AND TRADEMARK OFFICE

CERTIFICATE OF CORRECTION

PATENT NO. : 7,182,656 B2
APPLICATION NO. : 10/717034
DATED : February 27, 2007
INVENTOR(S) : Masayoshi Nanami et al.

It is certified that error appears in the above-identified patent and that said Letters Patent is hereby corrected as shown below:

Column 11, line 28, delete "P,R." and insert -- P, R. --, therefor. (Consider space).

Column 15, line 65, delete "overtured," and insert -- overturned, --, therefor.

Column 20, line 23, delete "cove" and insert -- cover --, therefor.

Signed and Sealed this

Eleventh Day of December, 2007

JON W. DUDAS
*Director of the United States Patent and Trademark Office*